US009851649B2

(12) United States Patent
Makabe et al.

(10) Patent No.: US 9,851,649 B2
(45) Date of Patent: Dec. 26, 2017

(54) TONER, DEVELOPER, IMAGE FORMING APPARATUS, AND IMAGE FORMING METHOD

(71) Applicants: Keiji Makabe, Shizuoka (JP); Tsuyoshi Sugimoto, Shizuoka (JP); Akinori Saito, Shizuoka (JP); Suzuka Amemori, Shizuoka (JP); Toyoshi Sawada, Kanagawa (JP); Hiroshi Yamashita, Shizuoka (JP); Shinya Nakayama, Shizuoka (JP); Atsushi Yamamoto, Osaka (JP); Daisuke Asahina, Shizuoka (JP); Satoyuki Sekiguchi, Shizuoka (JP)

(72) Inventors: Keiji Makabe, Shizuoka (JP); Tsuyoshi Sugimoto, Shizuoka (JP); Akinori Saito, Shizuoka (JP); Suzuka Amemori, Shizuoka (JP); Toyoshi Sawada, Kanagawa (JP); Hiroshi Yamashita, Shizuoka (JP); Shinya Nakayama, Shizuoka (JP); Atsushi Yamamoto, Osaka (JP); Daisuke Asahina, Shizuoka (JP); Satoyuki Sekiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/891,032

(22) PCT Filed: Nov. 27, 2013

(86) PCT No.: PCT/JP2013/082511

§ 371 (c)(1),
(2) Date: Nov. 13, 2015

(87) PCT Pub. No.: WO2014/184979

PCT Pub. Date: Nov. 20, 2014

(65) Prior Publication Data

US 2016/0091812 A1 Mar. 31, 2016

(30) Foreign Application Priority Data

May 14, 2013 (JP) ..... 2013-101950
Sep. 6, 2013 (JP) ..... 2013-185204

(51) Int. Cl.
*G03G 9/00* (2006.01)
*G03G 9/087* (2006.01)
*G03G 15/01* (2006.01)

(52) U.S. Cl.
CPC ..... *G03G 9/08788* (2013.01); *G03G 9/08755* (2013.01); *G03G 9/08791* (2013.01);
(Continued)

(58) Field of Classification Search
CPC ..... G03G 9/08788; G03G 9/08755; G03G 9/08791; G03G 9/08795; G03G 9/08797; G03G 9/08793
See application file for complete search history.

(56) References Cited

U.S. PATENT DOCUMENTS

2001/0046636 A1 11/2001 Daimon et al.
2003/0096184 A1* 5/2003 Kawaji ..... G03G 9/08702 430/109.3

(Continued)

FOREIGN PATENT DOCUMENTS

JP 63-027855 2/1988
JP 04-024702 4/1992

(Continued)

OTHER PUBLICATIONS

International Search Report Issued for counterpart International Patent Application No. PCT/JP2013/082511 dated Jan. 7, 2014.

(Continued)

*Primary Examiner* — Thorl Chea
(74) *Attorney, Agent, or Firm* — Oblon, McClelland, Maier & Neustadt, L.L.P.

(57) ABSTRACT

A toner includes a binder resin including a copolymer resin containing structural units derived from crystalline and non-crystalline resins, respectively. Spin-spin relaxation time (t50) of the toner at 50° C. measured by pulse NMR is ≤0.05 msec., spin-spin relaxation time (t130) at 130° C. when warmed from 50° C. to 130° C. is >15 msec., and spin-spin relaxation time (t'70) at 70° C. when cooled from 130° C. to 70° C. is ≤1.00 msec. A binarized image obtained by binarizing a phase image of the toner observed by a tapping mode AFM based on intermediate value between maximum and minimum phase difference values in the phase image includes first phase difference images constituted by large phase-difference portions and a second phase difference image constituted by a small phase-difference portion. The first phase difference images are dispersed in the second phase difference image. The dispersion diameter of the first phase difference images is 150 nm or less.

8 Claims, 6 Drawing Sheets

(52) U.S. Cl.
CPC ..... *G03G 9/08793* (2013.01); *G03G 9/08795* (2013.01); *G03G 9/08797* (2013.01); *G03G 15/0126* (2013.01)

(56) References Cited

U.S. PATENT DOCUMENTS

2006/0204880 A1* 9/2006 Mizutani ..... G03G 9/0806 430/109.4
2007/0092823 A1* 4/2007 Matsumura ..... G03G 9/08755 430/123.52
2008/0050669 A1 2/2008 Ohmura et al.
2011/0065039 A1* 3/2011 Ota ..... G03G 9/0821 430/109.3
2012/0052431 A1* 3/2012 Hozumi ..... G03G 9/0804 430/105
2013/0065172 A1 3/2013 Moriya et al.
2013/0130169 A1* 5/2013 Aoki ..... G03G 9/08755 430/109.4
2015/0132690 A1* 5/2015 Asahina ..... G03G 9/08755 430/105

FOREIGN PATENT DOCUMENTS

JP 04-024703 4/1992
JP 3360527 10/2002
JP 2004-138923 5/2004
JP 2006-071906 3/2006
JP 2006-235585 9/2006
JP 2006-251564 9/2006
JP 3910338 2/2007
JP 3949553 4/2007
JP 2007-286144 11/2007
JP 4155108 7/2008
JP 4218303 11/2008
JP 2010-151996 7/2010
JP 4569546 8/2010
JP 2012-027212 2/2012
JP 2013-076975 4/2013
RU 2 427 866 C2 8/2011
WO 2012011546 * 1/2012

OTHER PUBLICATIONS

Russian Official Decision on Grant dated Mar. 28, 2017, in Russian Patent Application No. 2015153194/28(081999) with English translation.

* cited by examiner

TONER, DEVELOPER, IMAGE FORMING APPARATUS, AND IMAGE FORMING METHOD

TECHNICAL FIELD

The present invention relates to a toner, a developer, an image forming apparatus, and an image forming method.

BACKGROUND ART

Conventionally, a latent image that is electrically or magnetically formed by an electrophotographic image forming apparatus is developed with an electrophotographic toner (hereinafter, may be referred to simply as "toner"). For example, in electrophotograph, an electrostatic charge image (latent image) is formed on a photoconductor, and then the latent image is developed with a toner, thereby to form a toner image. Usually, the toner image is transferred to a transfer material such as paper, and then fixed on the transfer material such as paper. In the fixing step of fixing the toner image on a transfer sheet, thermal fixing methods such as a heating roller fixing method and a heating belt fixing method are commonly used because these methods are energy-efficient.

Recently, there are increasing demands from the market for image forming apparatuses of high speed and energy saving, and therefore a toner having excellent low temperature fixability and capable of providing high quality images is desired. As a method for achieving the low temperature fixability of the toner, there is a method of lowering the softening point of the binder resin contained in the toner. However, when the softening temperature of the binder resin is low, it becomes easier for a so-called offset (also referred to as hot offset hereinafter) to occur, in which part of a toner image is deposited onto a surface of a fixing member during fixing, and then transferred to photocopy paper. In addition to this, the heat resistant storage stability of the toner degrades, and therefore toner particles are fused to each other particularly in high temperature environments, which is so called blocking. Besides, also in the developing device, problems occur that the toner melts and adheres to the interior of the developing device and the carrier to contaminate them, or that it becomes easier for the surface of the photoconductor to be filmed with the toner.

As for the technique for solving the aforementioned problems, it has been known to use a crystalline resin as a binder resin of the toner. Because the crystalline resin has a characteristic of rapidly softening from its crystallized state when it reaches the melting point, it can greatly lower the fixing temperature of the toner while maintaining the heat resistant storage stability at the temperature equal to or lower than the melting point. That is, the crystalline resin can realize both of low temperature fixability and heat resistant storage stability at high levels. However, the crystalline resin, which has a melting point at which it expresses low temperature fixability, is soft and would easily undergo plastic deformation, although it has excellent toughness. Therefore, when the only measure taken is to use the crystalline resin as the binder resin, the toner would be very poor in the mechanical durability and would cause various problems such as deformation, agglomeration, and solidification of the toner in the image forming apparatus, contamination of the members in the apparatus by the toner, etc.

Hence, many toners in which a crystalline resin and a non-crystalline resin are used in combination have been conventionally proposed as toners in which a crystalline resin is used as the binder resin (see, e.g., PTL 1 to PTL 5). As compared with conventional toners made of only a non-crystalline resin, these toners are excellent in realizing both low temperature fixability and heat resistant storage stability. However, if the crystalline resin is exposed above the surface of the toner, agglomerates of toner particles would occur from stirring stress in the developing device, which might cause transfer voids. Therefore, the proposed techniques have not been able to fully take advantage of the crystalline resin, because the additive amount of the crystalline resin has to be suppressed.

Further, many toners have been proposed that use a resin in which a crystalline segment and a non-crystalline segment are chemically bonded. For example, toners that use as a binder resin, a resin in which crystalline polyester and polyurethane are bonded are proposed (see, e.g., PTL 6 and PTL 7). Further, toners that use a resin in which crystalline polyester and amorphous vinyl polymer are bonded are proposed (see, e.g., PTL 8). Furthermore, toners that use as a binder resin, a resin in which crystalline polyester and non-crystalline polyester are bonded are proposed (see, e.g., PTL 9 to PTL 11).

Moreover, there are proposed a technique of adding inorganic fine particles to a binder resin, of which main component is a crystalline resin (see, e.g., PTL 12), and a technique for a toner that uses a crystalline resin having a cross-linked structure formed by an unsaturated bond containing a sulfonic acid group (see, e.g., PTL 13).

All of these proposed techniques are excellent in realizing both low temperature fixability and heat resistant storage stability, but have failed in fundamentally curing the soft characteristic attributed to the crystalline segment, and have not been able to solve the problems concerning the mechanical durability of the toner.

Furthermore, one major problem of a toner using a crystalline resin is the friction resistance of an image. After the toner has melted on a fixing medium by thermal fixation, it takes time for the crystalline resin in the toner to recrystallize, and hence the toner cannot rapidly restore its hardness on the surface of the image. Therefore, the toner would generate scars on the surface of the image or change the glossiness of the image due to contact and sliding friction with a sheet discharging roller, a conveying member, etc. in the sheet discharging step after the fixation.

Therefore, currently, a toner is demanded that can realize both of low temperature fixability and heat resistant storage stability at high levels, prevents transfer voids due to occurrence of agglomeration of toner particles in the developing device, and has excellent friction resistance.

CITATION LIST

Patent Literature

PTL 1 Japanese Patent (JP-B) No. 3,949,553

PTL 2 JP-B No. 4,155,108

PTL 3 Japanese Patent Application Laid-Open (JP-A) No. 2006-071906

PTL 4 JP-A No. 2006-251564

PTL 5 JP-A No. 2007-286144

PTL 6 Japanese Patent Application Publication (JP-B) No. 04-024702

PTL 7 JP-B No. 04-024703

PTL 8 JP-A No. 63-027855

PTL 9 JP-B No. 4,569,546

PTL 10 JP-B No. 4,218,303

PTL 11 JP-A No. 2012-27212

PTL 12 JP-B No. 3,360,527
PTL 13 JP-B No. 3,910,338

SUMMARY OF INVENTION

Technical Problem

The present invention aims to solve the conventional problems described above and achieve the following object.

That is, an object of the present invention is to provide a toner that can realize both low temperature fixability and heat resistant storage stability at high levels, prevents transfer voids due to occurrence of agglomeration of toner particles in the developing device, and has excellent friction resistance.

Solution to Problem

The means for solving the problems is as follows.

That is, a toner of the present invention is a toner containing at least a binder resin, wherein the binder resin includes a copolymer resin that includes a structural unit derived from a crystalline resin and a structural unit derived from a non-crystalline resin, wherein the spin-spin relaxation time (t50) of the toner at 50° C. measured by pulse NMR is 0.05 msec. or shorter, the spin-spin relaxation time (t130) of the toner at 130° C. when warmed from 50° C. to 130° C. is 15 msec. or longer, and the spin-spin relaxation time (t'70) of the toner at 70° C. when cooled from 130° C. to 70° C. is 1.00 msec. or shorter, and wherein a binarized image of the toner, which is obtained by binarizing a phase image of the toner observed by a tapping mode AFM based on the intermediate value between the maximum value and the minimum value of the phase difference in the phase image includes first phase difference images constituted by portions having a large phase difference and a second phase difference image constituted by a portion having a small phase difference, the first phase difference images are dispersed in the second phase difference image, and the dispersion diameter of the first phase difference images is 150 nm or less.

Advantageous Effects of Invention

The present invention can provide a toner that can solve the conventional problems described above, can realize both of low temperature fixability and heat resistant storage stability at high levels, prevents transfer voids due to occurrence of agglomeration of toner particles in the developing device, and has excellent friction resistance.

DESCRIPTION OF EMBODIMENTS (Toner)

Figure 1:
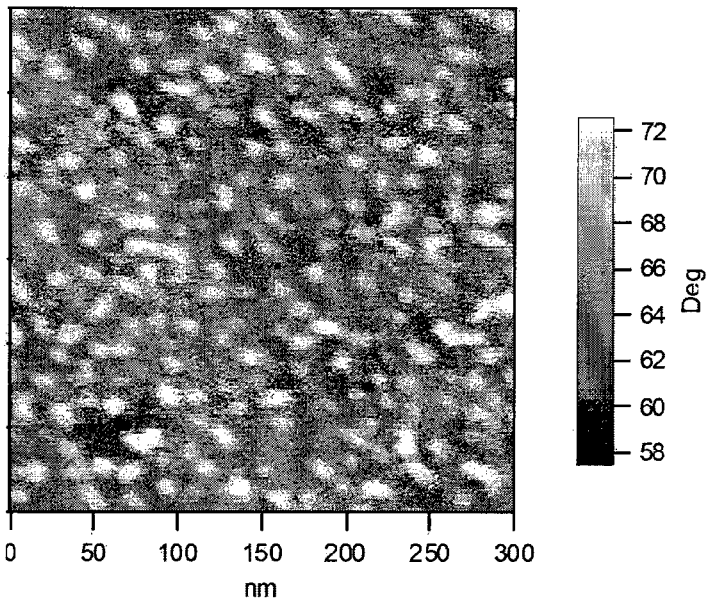
FIG. 1 is a phase image of a block copolymer resin of Manufacture Example 3-1.

A toner of the present invention contains at least a binder resin, and further contains other components according to necessity.

The binder resin contains a copolymer resin that includes a structural unit derived from a crystalline resin and a structural unit derived from a non-crystalline resin.

The spin-spin relaxation time (t50) of the toner at 50° C. measured by pulse NMR is 0.05 msec. or shorter. The spin-spin relaxation time (t130) of the toner at 130° C. when warmed from 50° C. to 130° C. is 15 msec. or longer. The spin-spin relaxation time (t'70) of the toner at 70° C. when cooled from 130° C. to 70° C. is 1.00 msec. or shorter.

A binarized image of the toner, which is obtained by binarizing a phase image of the toner observed by a tapping mode AFM based on the intermediate value between the maximum value and the minimum value of the phase difference in the phase image, includes first phase difference images constituted by portions having a large phase difference and a second phase difference image constituted by a portion having a small phase difference. The first phase difference images are dispersed in the second phase difference image. The dispersion diameter of the first phase difference images is 150 nm or less.

The present inventors have conducted earnest studies in order to provide a toner that can realize both of low temperature fixability and heat resistant storage stability, prevents transfer voids due to occurrence of agglomeration of toner particles in the developing device, and has excellent friction resistance. As a result, the present inventors have found out that if the spin-spin relaxation time (t50) of a toner at 50° measured by pulse NMR is 0.05 msec. or shorter, the spin-spin relaxation time (t130) of the toner at 130° C. when warmed from 50° C. to 130° C. is 15 msec. or longer, and the spin-spin relaxation time (t'70) of the toner at 70° C. when cooled from 130° C. to 70° C. is 1.00 msec. or shorter, it is possible to provide a toner that can realize both of low temperature fixability and heat resistant storage stability at high levels, prevents transfer voids due to occurrence of agglomeration of toner particles in the developing device, and has excellent friction resistance.

The present inventors have discovered a technical means for arresting molecular motions of a crystalline segment by chemically bonding the crystalline segment with a non-crystalline segment and controlling the structures of these segments. Use of this technology realizes the toner design described above. Then, with this toner, the problems described above can be solved.

The plastically deformable characteristic of a crystalline resin is considered due to the folded structure of a polymer chain in the crystalline segment. The crystalline segment includes crystalline sites in which molecular chains are folded and aligned together, a folded site at which the molecular chains are folded, and a non-crystalline site that is present between the crystalline sites. Even a straight-chain polyethylene single crystal with a high crystallinity contains non-crystalline sites in an amount of about 3%. It is considered that the high degree of molecular motion of this non-crystalline site greatly contribute to the plastic deformation of the crystalline resin. How much this molecular motion can be arrested is important in using a crystalline resin.

In order to design the toner described above, it is preferable to select a non-crystalline segment that can arrest molecular motion of a crystalline segment, form a micro phase-separated structure of the crystalline segment and the non-crystalline segment in the toner, and to regulate so as to make a minute sea-island structure between the non-crystalline segment, which is the sea, and the crystalline segment, which is the island. As a result, at the temperature equal to or lower than the melting point of the crystalline segment, the toner will have excellent mechanical durability, with the molecular motion of the non-crystalline segment arrested. In the fixing temperature range, the whole toner undergoes a rapid elastic relaxation and deforms. While the sheet is discharged, the non-crystalline segment instantly oppresses excessive molecular motion of the crystalline segment. Further, the minute sea-island structure prevents the crystalline segment from being exposed above the surface of the image, which enables rapid restoration of hardness on the image.

<Binder Resin>

The binder resin contains a copolymer resin, preferably contains a crystalline resin, and further contains other resins according to necessity.

—Copolymer Resin—

The copolymer resin is preferably a copolymer resin that contains a structural unit derived from a crystalline resin and a structural unit derived from a non-crystalline resin, and more preferably is a block copolymer resin.

Use of the copolymer resin makes it possible to form a specific high-order structure represented by a micro phase-separated structure.

The copolymer resin means a resin obtained by bonding different kinds of polymer chains by covalent bonding. Generally, different kinds of polymer chains are systems that are incompatible with each other, and do not mix with each other like water and oil. In a simple mixed system, the different kinds of polymer chains get macro phase-separated, because they can migrate independently. However, in a copolymer resin, the different kinds of polymer chains cannot macro phase-separate, because they are linked with each other. However, although they are linked, they are inclined to get separated from each other as much as possible by agglomerating with polymer chains of the same kind. Therefore, the only way left is that they separate alternately into portions that contain A in a larger amount and portions that contain B in a larger amount, based on the degree of the size of the polymer chains. Therefore, by changing phase mixing degree, composition, and length (molecular weight and distribution) of the component A and the component B, and their compounding ratio, it is possible to change the form (structure) of phase separation, and to control the structure to be a periodic ordered mesostructure such as a sphere structure, a cylinder structure, a gyroid structure, and a lamellar structure, as illustrated in, for example, A. K. Khandpur, S. Forster, and F. S. Bates, Macromolecules, 28 (1995), 8796-8806.

The copolymer resin is made of a crystalline component and a non-crystalline component. If it is possible to control the copolymer resin to be the periodic ordered mesostructure when crystallizing it from its micro phase-separated state, it is possible to have crystalline phases arranged regularly on the scale of from several ten nanometers to several hundred nanometers, by using a micro phase-separated structure of a molten material as a template. Therefore, with the use of these high-order structures, it is possible to secure sufficient flowability and deformability based on solid-liquid phase transition of the crystalline site in a situation where flowability is necessary such as fixation, and to arrest the moving characteristic by sealing the crystalline site within the structure in a situation where flowability and deformability are unnecessary such as storage, or a conveying step in the apparatus after fixation.

The molecular structure and the crystallinity of the copolymer resin, and the high-order structure thereof such as a micro phase-separated structure can be easily analyzed with conventionally known methods. Specifically, they can be confirmed with high-resolution NMR measurement ($^{1}H$, $^{13}C$, etc.), differential scanning calorimetry (DSC), wide-angle X-ray diffraction measurement, (thermal decomposition) GC/MS measurement, LC/MS measurement, infrared absorption (IR) spectral measurement, atomic force microscope measurement, and TEM observation.

For example, it is possible to judge whether the toner contains the copolymer resin prescribed in the present invention, in the following manner.

First, the toner is dissolved in a solvent such as ethyl acetate and THF (soxhlet extraction is also possible). Then, with a high-speed centrifuge having a cooling function, the resultant is subjected to centrifugation, for example, at 20° C. at 10,000 rpm×10 min, to be separated into a soluble content and an insoluble content. The soluble content is subjected to reprecipitation plural times so as to be purified. Through this process, the toner can be separated into a highly cross-linked resin component, a pigment, a wax, etc.

Then, GPC measurement of the obtained resin component is performed to obtain molecular weight and distribution, and chromatogram. At this time, if the obtained chromatogram is multimodal, fractionation and sorting of the resin component is performed with a fraction collector, and film formation is performed with each fraction. Through this operation, respective kinds of resin components are separated and purified, so that each resin component may be analyzed with various methods. Film formation of each fraction is performed by, for example, volatilizing the solvent with depressurized drying on a Teflon Petri dish.

The obtained purified film is first subjected to DSC measurement to find out its TG, melting point, crystallization behaviors, etc. When a crystallization peak is observed during a cooling/temperature lowering process, the crystalline component is grown by 24-hour or longer annealing in that temperature range in which the peak is observed. When crystallization is not observed but a melting peak is observed, annealing is performed at about a temperature that is lower than the melting point by 10° C. With this, it is possible to find out the various transition points and presence of a crystalline skeleton.

Next, with SPM observation, and as the case may be, together with TEM observation, presence or absence of a phase-separated structure is confirmed. When a so-called micro phase-separated structure can be confirmed, it means that the component observed is a copolymer resin, or a system that has a high intramolecular/intermolecular interaction.

Furthermore, it is possible to find out the composition, structure, and various characteristics of the purified film by performing FT-IR measurement, NMR measurement ($^{1}H$, $^{13}C$), GC/MS measurement, and as the case may be, NMR measurement (2D) that can analyze a molecular structure in more detail. With this, it is possible to confirm presence of a polyester skeleton and a urethane bond, and their compositions and composition ratio.

By comprehensively assessing the results of the above measurements and analyses, it is possible to judge whether the toner contains the copolymer resin prescribed in the present invention.

Here, an example of procedures and conditions of the above measurements will be described.

<Example of GPC Measurement>

The measurement can be performed with a GPC measuring instrument (e.g., HLC-8220 GPC, manufactured by Tosoh Corporation). A preferable measuring instrument is one that includes a fraction collector.

As the column, a 15 cm three-serial column TSKGEL SUPER HZM-H (manufactured by Tosoh Corporation) can be preferably used. The resin to be measured is prepared as a 0.15% by mass solution of tetrahydrofuran (THF) (containing a stabilizer, manufactured by Wako Pure Chemical Industries, Ltd.), and the obtained solution is filtrated through a 0.2 μm filter. The resulting filtrate is used as the sample. The THF sample solution (100 μL) is poured into the measuring instrument, and measured at a temperature of 40° C. at a flow rate of 0.35 mL/min.

Calculation of the molecular weight is performed with the use of a standard curve that is generated based on monodisperse polystyrene standard samples. As the monodisperse standard polystyrene samples, SHOWDEX STANDARD series manufactured by Showa Denko K.K. and toluene are used. THF solutions of the following three kinds of monodisperse polystyrene standard samples are prepared and measured on the conditions described above. With the retention time of a peak top regarded as the light-scattering molecular weight of the monodisperse polystyrene standard samples, a standard curve is generated.

Solution A: S-7450 (2.5 mg), S-678 (2.5 mg), S-46.5 (2.5 mg), S-2.90 (2.5 mg), THF (50 mL)

Solution B: S-3730 (2.5 mg), S-257 (2.5 mg), S-19.8 (2.5 mg), S-0.580 (2.5 mg), THF (50 mL)

Solution C: S-1470 (2.5 mg), S-112 (2.5 mg), S-6.93 (2.5 mg), toluene (2.5 mg), THF (50 mL)

As the detector, a RI (refraction index) detector can be used. However, when performing fractionation, an UV detector with a higher sensitivity may be used.

<Example of DSC Measurement>

The sample (5 mg) is sealed in T-ZERO simple hermetic pan manufactured by TA Instruments, and measured with DSC (Q2000 manufactured by TA Instruments).

The measurement is performed by elevating the temperature from 40° C. to 150° C. at the rate of 5° C./rain for the first heating, retaining the temperature for 5 minutes, and after this, lowering the temperature down to −70° C. at the rate of 5° C./min, and retaining the temperature for 5 minutes.

Then, for the second heating, the temperature is elevated at the temperature elevating rate of 5° C./min to measure thermal changes. A graph of "endothermic and exothermic amount" vs. "temperature" is plotted, and according to the usual method, Tg, cold crystallization, melting point, crystallization temperature, etc. are obtained. As Tg, a value obtained by a mid-point method from the DSC curve of the first heating is used. During the temperature elevation, it is also possible to separate an enthalpy relaxation component by ±0.3° C. modulation.

<Example of SPM Observation>

Observation is performed based on a phase image obtained by tapping mode using a SPM (e.g., an AFM).

In the copolymer resin of the present invention, it is preferable that soft portions that are observed as images having a large phase difference be minutely dispersed in a hard portion that is observed as an image having a small phase difference. In this case, it is important that first phase difference images, which are the soft portions having a large phase difference, be minutely dispersed as an internal phase in a second phase difference image, which is the hard portion having a small phase difference as an external phase.

As the sample to be observed for obtaining the phase image, for example, a resin block that is cut out as a section with an ultra microtome ULTRACUT UCT manufactured by Leica on the following conditions may be used.

Cutting thickness: 60 nm
Cutting speed: 0.4 mm/sec
With the use of a diamond knife (ULTRA SONIC 35°)

Examples of representative instruments for obtaining the AFM phase image include MFP-3D manufactured by Asylum Technology. With a cantilever OMCL-AC240TS-C3, the observation can be performed under the following measuring conditions.

Target amplitude: 0.5 V
Target percent: −5%
Amplitude setpoint: 315 mV
Scan rate: 1 Hz
Scan points: 256×256
Scan angle: 0°

<Example of TEM Observation>

[Procedures]

(1) The sample is exposed to an atmosphere of a $RuO_4$ aqueous solution, and stained for 2 hours.
(2) The sample is trimmed with a glass knife, and a section of the sample is created with an ultra microtome under the following conditions.

—Cutting Condition—

Cutting thickness: 75 nm
Cutting speed: 0.05 mm/sec to 0.2 mm/sec
With the use of a diamond knife (ULTRA SONIC 35°)

(3) The section is fixed on a mesh, exposed to an atmosphere of a $RuO_4$ aqueous solution, and stained for 5 minutes.

[Observation Conditions]

Instrument used: a transmission electron microscope JEM-2100F manufactured by JEOL Ltd.
Accelerating voltage: 200 kV
Morphological observation: bright-field microscopy
Settings: spot size: 3, CLAP: 1, OLAP: 3, Alpha: 3

<Example of FT-IR Measurement>

FT-IR spectral measurement is performed with a FT-IR spectrometer ("SPECTRUM ONE" manufactured by Perkin Elmer Japan Co., Ltd.) for 16 scans, at a resolution of 2 $cm^{-1}$, and in the mid-infrared range (from 400 $cm^{-1}$ to 4,000 $cm^{-1}$).

<Example of NMR Measurement>

The sample is dissolved in heavy chloroform to be as high a concentration as possible. Then, the resulting sample is poured into a 5 mmϕ NMR sample tube, and subjected to various NMR measurements. The measuring instrument used is JNM-ECX-300 manufactured by JEOL Resonance, Inc.

In all of these measurements, the measuring temperature is 30° C. The $^{1}H$-NMR measurement is performed for a total of 256 times, for a cycling time of 5.0 s. The $^{13}C$ measurement is performed for a total of 10,000 times, for a cycling time of 1.5 s. From the obtained chemical shift, the components are ascribed, and their corresponding peaks are integrated. The integral value is divided by the number of protons or carbons. From the obtained quotient, their compounding ratio can be calculated.

For a more in-depth structural analysis, double quantum filtered 1H-1H shift correlated two-dimensional NMR measurement (DQF-COSY) may be performed. In this case, the measurement is performed for a total of 1,000 times for a cycling time of 2.45 s or 2.80 s. From the obtained spectrum, the coupling state, i.e., the reaction site can be specified. However, the normal 1H and 13C measurement is enough for specification.

<Example of GC/MS>

In this analysis, reaction heat decomposition gas chromatography mass spectrometry (GC/MS) using a reaction reagent is performed. The reaction reagent used for the reaction heat decomposition GC/MS is a 10% by mass methanol solution of tetramethylammonium hydroxide (TMAH) (manufactured by Tokyo Chemical Industry Co., Ltd.). The GC-MS instrument used is QP2010 manufactured by Shimadzu Corporation, the data analyzing software used is GCMS SOLUTION manufactured by Shimadzu Corporation, and the heating apparatus used is PY2020D manufactured by Frontier Laboratories, Ltd.

[Analysis Condition]

Reaction heat decomposition temperature: 300° C.

Column: ULTRA ALLOY-5, L=30 m, ID=0.25 mm, Film=0.25 μm

Column temperature elevation: from 50° C. (retained for 1 minute), at the rate of 10° C./min, to 330° C. (retained for 11 minutes).

Carrier gas pressure: constant at 53.6 kPa

Column flow rate: 1.0 mL/min

Ionization method: EI method (70 eV)

Mass range: m/z, from 29 to 700

Injection mode: Split (1:100)

——Crystalline Resin——

The crystalline resin that is to constitute a structural unit of the copolymer resin is not particularly limited and may be appropriately selected according to the purpose. However, a crystalline polyester resin is preferable.

————Crystalline Polyester Resin————

The crystalline polyester resin is not particularly limited and may be appropriately selected according to the purpose. Examples thereof include a polycondensed polyester resin, a lactone ring-opening polymerization product, and a polyhydroxy carboxylic acid synthesized from polyol and a polycarboxylic acid.

The crystalline polyester resin is not particularly limited and may be appropriately selected according to the purpose. Preferable examples thereof include a crystalline polyester resin that contains as its constituent components, a dihydric aliphatic alcohol component and a divalent aliphatic carboxylic acid component.

————Polyol————

Examples of the polyol include dihydric diol, and trihydric to octahydric or higher polyols.

The dihydric diol is not particularly limited and may be appropriately selected according to the purpose. Examples thereof include: aliphatic alcohols (dihydric aliphatic alcohols) such as straight-chain aliphatic alcohol and branched aliphatic alcohol; alkylene ether glycol containing 4 to 36 carbon atoms; alicyclic diol containing 4 to 36 carbon atoms; alkylene oxide of the alicyclic diol (hereinafter, "alkylene oxide" may be abbreviated as "AO"); bisphenol AO adducts; polylactone diol; polybutadiene diol; diol containing a carboxyl group; diol containing a sulfonic acid group or a sulfamic acid group; and diol containing any other functional group such as the salt of those listed above. Among these, aliphatic alcohol containing 2 to 36 carbon atoms in the chain is preferable, and straight-chain aliphatic alcohol containing 2 to 36 carbon atoms in the chain is more preferable. These may be used alone, or two or more of these may be used in combination.

The content of the straight-chain aliphatic alcohol in the whole diol is not particularly limited and may be appropriately selected according to the purpose. However, it is preferably 80 mol % or higher, and more preferably 90 mol % or higher. The content of 80 mol % or higher is advantageous, because the crystallinity of the resin may be enhanced, low temperature fixability and heat resistant storage stability may be both realized, and the resin hardness may be enhanced.

The straight-chain aliphatic alcohol is not particularly limited and may be appropriately selected according to the purpose. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among them, preferred are ethylene glycol, 1,3-propanediol, 1,4-butanediol, 1,6-hexanediol, 1,9-nonanediol, and 1,10-decanediol, as they are readily available. Among them, straight-chain aliphatic alcohol containing 2 to 36 carbon atoms in the chain is preferable.

The branched aliphatic alcohol is not particularly limited and may be appropriately selected according to the purpose, but is preferably branched aliphatic alcohol containing 2 to 36 carbon atoms in the chain. Examples of the branched aliphatic alcohol include 1,2-propylene glycol, neopentyl glycol, and 2,2-diehtyl-1,3-propanediol.

The alkylene ether glycol containing 4 to 36 carbon atoms is not particularly limited and may be appropriately selected according to the purpose. Examples thereof include diethylene glycol, triethylene glycol, dipropylene glycol, polyethylene glycol, polypropylene glycol, and polytetramethylene ether glycol.

The alicyclic diol containing 4 to 36 carbon atoms is not particularly limited and may be appropriately selected according to the purpose. Examples thereof include 1,4-cyclohexane dimethanol and hydrogenated bisphenol A.

The trihydric to octahydric or higher polyol is not particularly limited and may be appropriately selected according to the purpose. Examples thereof include: trihydric to octahydric or higher polyhydric aliphatic alcohol containing 3 to 36 carbon atoms; trisphenol-AO adducts (with 2 to 30 moles added); novolak resin-AO adducts (with 2 to 30 moles added); and acrylic polyol such as copolymer of hydroxyethyl (meth)acrylate and another vinyl-based monomer.

Examples of the trihydric to octahydric or higher polyhydric aliphatic alcohol include glycerin, trimethylolethane, trimethylolpropane, pentaerythritol, sorbitol, sorbitan, and polyglycerin.

Among these, trihydric to octahydric or higher polyhydric aliphatic alcohol and novolak resin-AO adducts are preferable, and novolak resin-AO adducts are more preferable.

————Polycarboxylic Acid————

Examples of the polycarboxylic acid include dicarboxylic acid, and trivalent to hexavalent or higher polycarboxylic acid.

The dicarboxylic acid is not particularly limited and may be appropriately selected according to the purpose. Examples thereof include aliphatic dicarboxylic acid (divalent aliphatic carboxylic acid) and aromatic dicarboxylic acid. Examples of the aliphatic dicarboxylic acid include straight-chain aliphatic dicarboxylic acid and branched aliphatic dicarboxylic acid. Among these, straight-chain aliphatic dicarboxylic acid is preferable.

The aliphatic dicarboxylic acid is not particularly limited and may be appropriately selected according to the purpose. Examples thereof include alkane dicarboxylic acid, alkenyl succinic acid, alkene dicarboxylic acid, and alicyclic dicarboxylic acid.

Examples of the alkane dicarboxylic acid include alkane dicarboxylic acid containing 4 to 36 carbon atoms. Examples of the alkane dicarboxylic acid containing 4 to 36 carbon atoms include succinic acid, adipic acid, sebacic acid, azelaic acid, dodecanedicarboxylic acid, octadecanedicarboxylic acid, and decylsuccinic acid.

Examples of the alkenyl succinic acid include dodecenyl succinic acid, pentadecenyl succinic acid, and octadecenyl succinic acid.

Examples of the alkene dicarboxylic acid include alkene dicarboxylic acid containing 4 to 36 carbon atoms. Examples of the alkene dicarboxylic acid containing 4 to 36 carbon atoms include maleic acid, fumaric acid, and citraconic acid.

Examples of the alicyclic dicarboxylic acid include alicyclic dicarboxylic acid containing 6 to 40 carbon atoms. Examples of the alicyclic dicarboxylic acid containing 6 to 40 carbon atoms include dimer acid (dimerized linoleic acid).

The aromatic dicarboxylic acid is not particularly limited and may be appropriately selected according to the purpose. Examples thereof include aromatic dicarboxylic acid containing 8 to 36 carbon atoms.

Examples of the aromatic dicarboxylic acid containing 8 to 36 carbon atoms include phthalic acid, isophthalic acid, terephthalic acid, t-butylisophthalic acid, 2,6-naphthalene dicarboxylic acid, and 4,4'-biphenyl dicarboxylic acid.

Examples of the trivalent to hexavalent or higher polycarboxylic acid include aromatic polycarboxylic acid containing 9 to 20 carbon atoms. Examples of the aromatic polycarboxylic acid containing 9 to 20 carbon atoms include trimellitic acid and pyromellitic acid.

As the dicarboxylic acid or the trivalent to hexavalent or higher polycarboxylic acid, acid anhydride of those listed above or alkyl ester of those listed above containing 1 to 4 carbon atoms may be used. Examples of the alkyl ester containing 1 to 4 carbon atoms include methyl ester, ethyl ester, and isopropyl ester.

Among the dicarboxylic acids, it is preferable to use the aliphatic dicarboxylic acid alone. It is more preferable to use adipic acid, sebacic acid, dodecanedicarboxylic acid, terephthalic acid, or isophthalic acid alone. A copolymerization product of the aliphatic dicarboxylic acid and the aromatic dicarboxylic acid is likewise preferable. Preferable examples of the aromatic dicarboxylic acid to be copolymerized include terephthalic acid, isophthalic acid, t-butylisophthalic acid, and alkyl ester of these aromatic dicarboxylic acid. Examples of the alkyl ester include methyl ester, ethyl ester, and isopropyl ester. The amount of the aromatic dicarboxylic acid to be copolymerized is preferably 20 mol % or less.

The melting point of the crystalline resin is not particularly limited and may be appropriately selected according to the purpose. However, it is preferably from 50° C. to 80° C., and more preferably from 60° C. to 80° C. When the melting point is lower than 50° C., the crystalline resin tends to melt at a low temperature, which would degrade the heat resistant storage stability of the toner. When the melting point is higher than 80° C., the crystalline resin would not melt sufficiently when heated for fixation, which would degrade the low temperature fixability of the toner.

The hydroxyl value of the crystalline resin is not particularly limited and may be appropriately selected according to the purpose. It is preferably from 5 mgKOH/g to 40 mgKOH/g.

The crystallinity, the molecular structure, etc. of the crystalline resin can be confirmed with NMR measurement, differential scanning calorimetry (DSC) measurement, X-ray diffractometry, GC/MS measurement, LC/MS measurement, infrared absorption (IR) spectral measurement, etc.

——Non-Crystalline Resin——

The non-crystalline resin that is to constitute a structural unit of the copolymer resin is not particularly limited and may be appropriately selected according to the purpose. However, a non-crystalline polyester resin is preferable.

———Non-Crystalline Polyester Resin———

The non-crystalline polyester resin is not particularly limited and may be appropriately selected according to the purpose. Examples thereof include a polycondensed polyester resin synthesized from polyol and polycarboxylic acid.

The non-crystalline polyester resin is not particularly limited and may be appropriately selected according to the purpose. However, a non-crystalline polyester resin that contains as its constituent components, a dihydric aliphatic alcohol component and a polyvalent aromatic carboxylic acid component is preferable.

————Polyol————

Examples of the polyol include dihydric diol, and trihydric to octahydric or higher polyol.

The dihydric diol is not particularly limited and may be appropriately selected according to the purpose. Examples thereof include aliphatic alcohol (dihydric aliphatic alcohol) such as straight-chain aliphatic alcohol and branched aliphatic alcohol. Among these, aliphatic alcohol containing 2 to 36 carbon atoms in the chain is preferable, and straight-chain aliphatic alcohol containing 2 to 36 carbon atoms in the chain is more preferable. One of these may be used alone, or two or more of these may be used in combination.

The straight-chain aliphatic alcohol is not particularly limited and may be appropriately selected according to the purpose. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among them, preferred are ethylene glycol, 1,3-propanediol (propylene glycol), 1,4-butanediol, 1,6-hexanediol, 1,9-nonanediol, and 1,10-decanediol, as they are readily available. Among them, straight-chain aliphatic alcohol containing 2 to 36 carbon atoms in the chain is preferable.

————Polycarboxylic Acid————

Examples of the polycarboxylic acid include dicarboxylic acid, trivalent to hexavalent or higher polycarboxylic acid. Among these, polyvalent aromatic carboxylic acid is preferable.

The dicarboxylic acid is not particularly limited and may be appropriately selected according to the purpose. Examples thereof include aliphatic dicarboxylic acid and aromatic dicarboxylic acid. Examples of the aliphatic dicarboxylic acid include straight-chain aliphatic dicarboxylic acid and branched aliphatic dicarboxylic acid. Among these, straight-chain aliphatic dicarboxylic acid is preferable.

The aliphatic dicarboxylic acid is not particularly limited and may be appropriately selected according to the purpose.

Examples thereof include alkane dicarboxylic acid, alkenyl succinic acid, alkene dicarboxylic acid, and alicyclic dicarboxylic acid.

Examples of the alkane dicarboxylic acid include alkane dicarboxylic acid containing 4 to 36 carbon atoms. Examples of the alkane dicarboxylic acid containing 4 to 36 carbon atoms include succinic acid, adipic acid, sebacic acid, azelaic acid, dodecanedicarboxylic acid, octadecanedicarboxylic acid, and decylsuccinic acid.

Examples of the alkenyl succinic acid include dodecenyl succinic acid, pentadecenyl succinic acid, and octadecenyl succinic acid.

Examples of the alkene dicarboxylic acid include alkene dicarboxylic acid containing 4 to 36 carbon atoms. Examples of the alkene dicarboxylic acid containing 4 to 36 carbon atoms include maleic acid, fumaric acid, and citraconic acid.

Examples of the alicyclic dicarboxylic acid include alicyclic dicarboxylic acid containing 6 to 40 carbon atoms. Examples of the alicyclic dicarboxylic acid containing 6 to 40 carbon atoms include dimer acid (dimerized linoleic acid).

The aromatic dicarboxylic acid is not particularly limited and may be appropriately selected according to the purpose. Examples thereof include aromatic dicarboxylic acid containing 8 to 36 carbon atoms. Examples of the aromatic dicarboxylic acid containing 8 to 36 carbon atoms include phthalic acid, isophthalic acid, terephthalic acid, t-butylisophthalic acid, 2,6-naphthalene dicarboxylic acid, and 4,4'-biphenyl dicarboxylic acid.

Examples of the trivalent to hexavalent or higher polycarboxylic acid include aromatic polycarboxylic acid containing 9 to 20 carbon atoms. Examples of the aromatic polycarboxylic acid containing 9 to 20 carbon atoms include trimellitic acid and pyromellitic acid.

As the dicarboxylic acid or the trivalent to hexavalent or higher polycarboxylic acid, acid anhydride of those listed above or alkyl ester of those listed above containing 1 to 4 carbon atoms may be used. Examples of the alkyl ester containing 1 to 4 carbon atoms include methyl ester, ethyl ester, and isopropyl ester.

The glass transition temperature of the non-crystalline resin is not particularly limited and may be appropriately selected according to the purpose. However, it is preferably from 40° C. to 75° C., and more preferably from 55° C. to 75° C. When the glass transition temperature is lower than 40° C., the heat resistant storage stability might degrade, and durability against stress of stirring, etc. in the developing device might degrade. When the glass transition temperature is higher than 75° C., the low temperature fixability might degrade. The glass transition temperature of the non-crystalline resin can be measured by, for example, differential scanning calorimetry (DSC method).

The hydroxyl value of the non-crystalline resin is not particularly limited and may be appropriately selected according to the purpose. However, it is preferably from 5 mgKOH/g to 40 mgKOH/g.

The molecular structure of the non-crystalline resin can be confirmed with GC/MS, LC/MS, and IR measurement, as well as NMR measurement based on a solution and a solid.

——Copolymerization——

The method for producing the copolymer resin is not particularly limited and may be appropriately selected according to the purpose. Examples of such methods include the following methods (1) to (3). The methods (1) and (3) are preferable, and the method (1) is more preferable, in terms of latitude allowed in molecular design.

(1) A method of dissolving or dispersing in an appropriate solvent, a non-crystalline resin prepared in advance by a polymerization reaction and a crystalline resin prepared in advance by a polymerization reaction, and copolymerizing them through reaction with an elongating agent that contains two or more functional groups such as isocyanate group, epoxy group, and carbodiimide group that can react with a hydroxyl group or a carboxylic acid at the terminal of a polymer chain.

(2) A method of melting and kneading a non-crystalline resin prepared in advance by a polymerization reaction and a crystalline resin prepared in advance by a polymerization reaction, and preparing a copolymer through an ester exchange reaction under a reduced pressure.

(3) A method of using a hydroxyl group contained in a crystalline resin prepared in advance by a polymerization reaction as a polymerization initiating component, ring-opening-polymerizing a non-crystalline resin from the terminal of a polymer chain of the crystalline resin, and copolymerizing them.

Polyisocyanate is preferable as the elongating agent.

Examples of the polyisocyanate include diisocyanate.

Examples of the diisocyanate include aromatic diisocyanate, aliphatic diisocyanate, alicyclic diisocyanate, and aromatic aliphatic diisocyanate.

Examples of the aromatic diisocyanate include 1,3-phenylene diisocyanate, 1,4-phenylene diisocyanate, 2,4-tolylene diisocyanate (TDI), 2,6-tolylene diisocyanate (TDI), crude TDI, 2,4'-diphenyl methane diisocyanate (MDI), 4,4'-diphenyl methane diisocyanate (MDI), crude MDI, 1,5-naphthylene diisocyanate, m-isocyanate phenylsulfonyl isocyanate, and p-isocyanate phenylsulfonyl isocyanate.

Examples of the aliphatic diisocyanate include ethylene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyanate methyl caproate, bis(2-isocyanate ethyl) fumarate, bis(2-isocyanate ethyl) carbonate, and 2-isocyanate ethyl-2,6-diisocyanate hexanoate.

Examples of the alicyclic diisocyanate include isophorone diisocyanate (IPDI), dicyclohexyl methane-4,4'-diisocyanate (hydrogenated MDI), cyclohexylene diisocyanate, methyl cyclohexylene diisocyanate (hydrogenated TDI), bis (2-isocyanate ethyl)-4-cyclohexene-1,2-dicarboxylate, 2,5-norbornane diisocyanate, and 2,6-norbornane diisocyanate.

Examples of the aromatic aliphatic diisocyanate include m-xylylene diisocyanate (XDI), p-xylylene diisocyanate (XDI), and α,α,α',α'-tetramethyl xylylene diisocyanate (TMXDI).

The amount of the polyisocyanate to be used for producing the copolymer resin is not particularly limited and may be appropriately selected according to the purpose. However, when the amount of the polyisocyanate to be used is converted to a ratio of the total number of moles of hydroxyl group contained in the crystalline resin and the non-crystalline resin to the total number of moles of isocyanate group contained in polyisocyanate (OH/NCO), it is preferably from 0.5 to 0.8. When the ratio OH/NCO is less than 0.5, the non-crystalline resin and the crystalline resin will not be joined with each other sufficiently, and much of them will be present independently from each other, which would make it impossible to secure the stability of the quality. When the ratio OH/NCO is greater than 0.8, influences of the molecular weight of the copolymer resin and of interaction between urethane groups will be excessively strong, which would make it impossible to secure sufficient flowability and deformability when flowability is necessary.

The molar ratio between the crystalline resin and the non-crystalline resin in the copolymer resin (crystalline resin/non-crystalline resin) is not particularly limited and may be appropriately selected according to the purpose. However, it is preferably from 10/90 to 40/60, and more preferably from 20/80 to 35/75.

As the ratio of the crystalline resin in the copolymer resin becomes greater, the melt viscosity of the copolymer resin becomes lower and the low temperature fixability thereof is improved. Furthermore, strength is expressed in the copolymer resin by crystallization, and thus static storage stability thereof is improved.

However, when the ratio of the crystalline resin in the copolymer resin is excessively large, mobility arresting will be poor when the copolymer resin is cooled, which would degrade the plate wear resistance and stack storage stability. Furthermore, a strong shear stress such as white voids might be reduced, and charging influence-related durabilities might be degraded.

The number of moles of the crystalline resin and the number of moles of the non-crystalline resin can be calculated according to the following formula.

$$\text{Number of moles}=(\text{weight of the resin (g)}\times\text{OHV}/56.11)/1{,}000$$

where OHV is the hydroxyl value, and the unit thereof is mgKOH/g.

—Crystalline Resin—

The crystalline resin as one component of the binder resin is not particularly limited and may be appropriately selected according to the purpose. Examples thereof include the crystalline resin explained as the structural unit of the copolymer resin.

The content of the crystalline resin is not particularly limited and may be appropriately selected according to the purpose. However, it is preferably from 3% by mass to 10% by mass.

By the toner containing the crystalline resin, crystallization is facilitated, and strength is expressed, which would improve static storage stability, and the melt viscosity becomes lower, which would realize better low temperature fixability.

<Other Components>

Examples of the other components include a colorant, a releasing agent, a charge controlling agent, and an external additive.

—Colorant—

The colorant is not particularly limited and may be appropriately selected according to the purpose. Examples thereof include black pigments, yellow pigments, magenta pigments, and cyan pigments. Among them, incorporation of any of yellow pigments, magenta pigments, and cyan pigments is preferred.

The black pigments are used, for example, in black toners. Examples of black pigments include carbon black, copper oxide, manganese dioxide, aniline black, activated carbon, non-magnetic ferrite, magnetite, nigrosine dyes, and black iron oxide.

The yellow pigments are used, for example, in yellow toners. Examples of yellow pigments include C.I. Pigment Yellow 74, 93, 97, 109, 128, 151, 154, 155, 166, 168, 180, and 185, Naphthol Yellow S, Hanza Yellow (10G, 5G, G), cadmium yellow, yellow iron oxide, Chinese yellow, chrome yellow, titanium yellow, and polyazo yellow.

The magenta pigments are used, for example, in magenta toners. Examples of magenta pigments include monoazo pigments such as quinacridone-based pigments and C.I. Pigment Red 48:2, 57:1, 58:2, 5, 31, 146, 147, 150, 176, 184, and 269. The monoazo pigments may be used in combination with the quinacridone-based pigments.

The cyan pigments are used, for example, in cyan toners. Examples of cyan pigments include Cu-phthalocyanine pigments, Zn-phthalocyanine pigments, and Al-phthalocyanine pigments.

The content of the colorant is not particularly limited and may be appropriately selected according to the purpose. However, it is preferably from 1 part by mass to 15 parts by mass, and more preferably from 3 parts by mass to 10 parts by mass relative to 100 parts by mass of the toner.

The colorants can also be used as a master batch composited with resins. Examples of resins to be used in the production of the master batch or to be kneaded together with the master batch include polymers of styrene or substituted styrene such as polystyrene, poly-p-chlorostyrene, and polyvinyltoluene; styrenic copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-chloromethyl methacrylate copolymers, styrene-acrylonitrile copolymers, styrene-vinylmethylketone copolymers, styrene-butadiene copolymers, styrene-isoprene copolymers, styrene-acrylonitrile-indene copolymers, styrene-maleic acid copolymers, and styrene-maleic ester copolymers; and polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acid resins, rosins, modified rosins, terpene resins, aliphatic or alicyclic hydrocarbon resins, aromatic petroleum resins, chlorinated paraffins, and paraffin waxes. One of these may be used alone, or two or more of these may be used in combination.

The master batch can be obtained by mixing the resin for the master batch and the colorant while applying a high shear force and kneading the mixture. An organic solvent may be used to enhance an interaction between the colorant and the resin. Further, a method that is so-called "flushing method" including mixing and kneading an aqueous paste of the colorant with the resin and the organic solvent, allowing the colorant to be transferred to the resin side, and removing the water and the organic solvent component is also preferred, because a wet cake of the colorant as such may be used and, thus, drying is unnecessary. High-shearing dispersers such as three-roll mills are preferred for mixing and kneading purposes.

—Releasing Agent—

The releasing agent is not particularly limited and may be appropriately selected according to the purpose. Examples thereof include a carbonyl group-containing wax, a polyolefin wax, and long-chain hydrocarbon. One of these may be used alone, or two or more of these may be used in combination. Among these, a carbonyl group-containing wax is preferable.

Examples of the carbonyl group-containing wax include polyalkanoic esters, polyalkanol esters, polyalkanoic acid amides, and dialkyl ketones.

Examples of the polyalkanoic esters include carnauba wax, montan wax, trimethylolpropane tribehenate, pentaerythritol tetrabehenate, pentaerythritol diacetate dibehenate, glycerin tribehenate, and 1,18-octadecanediol distearate.

Examples of the polyalkanol esters include tristearyl trimellitate and distearyl maleate.

Examples of the polyalkanoic acid amides include dibehenylamide.

Examples of the polyalkylamides include trimellitic acid tristearylamide.

Examples of the dialkyl ketones include distearyl ketone.

Among these carbonyl group-containing waxes, polyalkanoic esters are particularly preferable.

Examples of the polyolefin wax include polyethylene wax and polypropylene wax.

Examples of the long-chain hydrocarbon include paraffin wax and SASOL wax.

The melting point of the releasing agent is not particularly limited and may be appropriately selected according to the purpose. However, it is preferably from 50° C. to 100° C., and more preferably from 60° C. to 90° C. When the melting point is lower than 50° C., the heat resistant storage stability might be adversely affected. When the melting point is higher than 100° C., it is more likely for a cold offset to occur during fixation at a low temperature.

The melting point of the releasing agent can be measured with, for example, differential scanning calorimeters (TA-60WS and DSC-60 manufactured by Shimadzu Corporation). First, the releasing agent is set in an aluminum-made sample vessel, which is then mounted on a holder unit to be set in an electric furnace. Then, under a nitrogen atmosphere, the sample is warmed from 0° C. to 150° C. at a temperature elevating rate of 10° C./min, and then cooled from 150° C. to 0° C. at a temperature lowering rate of 10° C./min. After this, the sample is again warmed to 150° C. at a temperature elevating rate of 10° C./min. In this way, a DSC curve is measured. From the obtained DSC curve, the maximum peak temperature of heat of melting in the second temperature elevation can be obtained as the melting point, with the analyzing program of the DSC-60 system.

The melt viscosity of the releasing agent is preferably from 5 mPa·sec to 100 mPa·sec, more preferably from 5 mPa·sec to 50 mPa·sec, and particularly preferably from 5 mPa·sec to 20 mPa·sec, when measured at 100° C. When the melt viscosity is lower than 5 mPa·sec, the releasability might degrade. When the melt viscosity is higher than 100 mPa·sec, hot offset resistance and releasability at low temperatures might degrade.

The content of the releasing agent is not particularly limited and may be appropriately selected according to the purpose. However, it is preferably from 1 part by mass to 20 parts by mass, and more preferably from 3 parts by mass to 10 parts by mass relative to 100 parts by mass of the toner. When the content is less than 1 part by mass, hot offset resistance might degrade. When the content is greater than 20 parts by mass, heat resistant storage stability, chargeability, transferability, and stress resistance might degrade.

—Charge Controlling Agent—

The charge controlling agent is not particularly limited and may be appropriately selected according to the purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluoroactive agents, metal salts of salicylic acid, and metal salts of salicylic acid derivatives. Specific examples thereof include nigrosine dye BONTRON 03, quaternary ammonium salt BONTRON P-51, metal-containing azo dye BONTRON S-34, oxynaphthoic acid metal complex E-82, salicylic acid metal complex E-84 and phenol condensate E-89 (these products are of ORIENT CHEMICAL INDUSTRIES CO., LTD), quaternary ammonium salt molybdenum complexes TP-302 and TP-415 (these products are of Hodogaya Chemical Co., Ltd.), LRA-901 and boron complex LR-147 (a product of Japan Carlit Co., Ltd.).

The content of the charge controlling agent is not particularly limited and may be appropriately selected according to the purpose. However, it is preferably from 0.01 parts by mass to 5 parts by mass, and more preferably from 0.02 parts by mass to 2 parts by mass relative to 100 parts by mass of the toner. When the content is less than 0.01 parts by mass, charge rising property and the amount of charges to be built up will not be sufficient, which would influence a toner image. When the content is greater than 5 parts by mass, the chargeability of the toner will be excessively high to increase electrostatic attraction between the toner and the developing roller, which would bring about degradation of the flowability of the developer or degradation of the image density.

—External Additive—

The external additive is not particularly limited and may be appropriately selected according to the purpose. Examples thereof include silica, fatty acid metal salts, metal oxides, hydrophobized titanium oxide, and fluoro polymers.

Examples of the fatty acid metal salts include zinc stearate and aluminum stearate.

Examples of the metal oxides include titanium oxide, aluminum oxide, tin oxide, and antimony oxide.

Examples of commercially available products of the silica include R972, R974, RX200, RY200, R202, R805, and R812 (all of which are manufactured by Nippon Aerosil Co., Ltd.).

Examples of commercially available products of the titanium oxide include P-25 (manufactured by Nippon Aerosil Co., Ltd.), STT-30, and STT-65C-S (both of which are manufactured by Titan Kogyo, Ltd.), TAF-140 (manufactured by Fuji Titanium Industry Co., Ltd.), and MT-150W, MT-500B, MT-600B, and MT-150A (all of which are manufactured by Tayca Corporation).

Examples of commercially available products of the hydrophobized titanium oxide include T-805 (manufactured by Nippon Aerosil Co., Ltd.), STT-30A and STT-65S-S (both of which are manufactured by Titan Kogyo, Ltd.), TAF-500 T and TAF-1500T (both of which are manufactured by Fuji Titanium Industry Co., Ltd.), MT-100S and MT-100T (both of which are manufactured by Tayca Corporation), and IT-S (manufactured by Ishihara Sangyo Kaisha Ltd.).

Examples of hydrophobizing methods include treating hydrophilic fine particles with a silane coupling agent such as methyltrimethoxysilane, methyltriethoxysilane, or octyltrimethoxysilane.

The content of the external additive is not particularly limited and may be appropriately selected according to the purpose. However, it is preferably from 0.1 parts by mass to 5 parts by mass, and more preferably from 0.3 parts by mass to 3 parts by mass relative to 100 parts by mass of the toner.

The average particle diameter of the primary particles of the external additive is not particularly limited and may be appropriately selected according to the purpose. However, it is preferably 100 nm or smaller, and more preferably from 3 nm to 70 nm. When the average particle diameter is smaller than 3 nm, the external additive might be buried in the toner and might not be able to exert its functionality effectively. When the average particle diameter is greater than 100 nm, the external additive might damage the surface of the photoconductor non-uniformly.

The volume average particle diameter of the toner is not particularly limited and may be appropriately selected according to the purpose. However, it is preferably from 0.1 μm to 16 μm. The upper limit thereof is more preferably 11 μm, and particularly preferably 9 μm. The lower limit thereof is more preferably 0.5 μm, and particularly preferably 1 μm.

The ratio of the volume average particle diameter of the toner to the number average particle diameter thereof [volume average particle diameter/number average particle diameter] is not particularly limited and may be appropriately selected according to the purpose. However, it is preferably from 1.0 to 1.4, and more preferably from 1.0 to 1.3 in terms of particle diameter uniformity.

The volume average particle diameter (Dv) and the number average particle diameter (Dn) are measured according to Coulter counter method. Examples of measuring instruments include COULTER COUNTER TA-II, COULTER MULTISIZER II, and COULTER MULTISIZER III (all of which are manufactured by Beckman Coulter). A measuring method will be described below.

First, a surfactant (preferably, alkyl benzene sulfonate) (0.1 mL to 5 mL) is added as a dispersant to an electrolytic aqueous solution (100 mL to 150 mL). Here, the electrolytic solution is an about 1% by mass NaCl aqueous solution prepared by using primary sodium chloride. Examples of the electrolytic solution include ISOTON-II (manufactured by Beckman Coulter). Then, the sample to be measured (2 mg to 20 mg) is added to the solution. The electrolytic solution in which the sample is suspended is subjected to dispersion for about 1 minute to 3 minutes with an ultrasonic disperser. Then, with the measuring instrument mentioned above, and with a 100 μm aperture, the volume and number of the toner particles or of the toner are measured to calculate the volume distribution and number distribution. From the obtained distributions, the volume average particle size and number average particle size of the toner can be obtained.

Channels to be used are 13 channels, namely channels of 2.00 μm or greater but less than 2.52 μm; 2.52 μm or greater but less than 3.17 μm; 3.17 μm or greater but less than 4.00 μm; 4.00 μm or greater but less than 5.04 μm; 5.04 μm or greater but less than 6.35 μm; 6.35 μm or greater but less than 8.00 μm; 8.00 μm or greater but less than 10.08 μm; 10.08 μm or greater but less than 12.70 μm; 12.70 μm or greater but less than 16.00 μm; 16.00 μm or greater but less than 20.20 μm; 20.20 μm or greater but less than 25.40 μm; 25.40 μm or greater but less than 32.00 μm; and 32.00 μm or greater but less than 40.30 μm, and the target particles are of a particle diameter of 2.00 μm or greater but less than 40.30 μm.

<Characteristics Required in Pulse NMR>

The essential feature of the present invention is the technical means of chemically bonding a crystalline resin with a non-crystalline segment and controlling the structures of the respective segments to thereby arrest the molecular motion of the crystalline segment.

Pulse NMR (hereinafter, may be referred to as "pulse method NMR") is effective for indexing molecular mobility. Unlike high resolution NMR, the pulse method NMR does not provide chemical shift information (such as a local chemical structure). Instead, the pulse method NMR can rapidly measure relaxation times of a 1H nucleus (spin-lattice relaxation time (T1) and spin-spin relaxation time (T2)), which are closely related to molecular mobility, and hence use of this method has become rapidly widespread. Example measuring methods based on the pulse method NMR include Hahn echo method, solid echo method, car Parcel Meibumu Gill method (CPMG method), and 90° pulse method. Generally, the solid echo method and the 90° pulse method are suitable for measuring a short T2. The Hahn echo method is suitable for measuring T2 of a middle length. The CMPG method is suitable for measuring a long T2. In the measurement of a toner, any method can be used suitably, but the solid echo method and the Hahn echo method are more suitable.

In the present invention, a spin-spin relaxation time (t50) at 50° C. is specified as the index of molecular mobility related to the storage stability. A spin-spin relaxation time (t130) at 130° C. is specified as the index of molecular mobility related to the fixation. A spin-spin relaxation time (t'70) at 70° C. when cooled from 130° C. to 70° C. is specified as the index of molecular mobility related to friction resistance when an image is conveyed.

When specific ranges are satisfied as these specified indices, it means that a sufficient mobility will be secured for when flowability is necessary such as during fixation, and that the mobility will be arrested sufficiently for when flowability is unnecessary such as during storage or conveying in the device.

The relaxation times t50, t130, and t'70 of the toner will be explained.

The relaxation time t50 of the toner, which is the index of molecular mobility related to the storage stability, is 0.05 msec. or shorter. When t50 is longer than 0.05 msec., the toner mobility at 50° C. is high, which makes it more likely for the toner to deform or agglomerate under an external force, which is unfavorable because overseas shipment and storage in the summer time or by sea would be disadvantaged.

The relaxation time t130 of the toner, which is the index of molecular mobility related to the fixability, is 15 msec. or longer. When t130 is shorter than 15 msec., the molecular mobility during heating will be insufficient, which would degrade the flowability and deformability of the toner. This would degrade the ductility and malleability of an image and adhesiveness to a printing target, which in turn would lead to degradation of image quality such as degradation of glossiness and peeling of an image, which is unfavorable.

Further, the relaxation time t'70, which is the index of molecular mobility related to friction resistance when an image is conveyed, is 1.00 msec. or shorter. When t'70 is longer than 1.00 msec., contact and sliding friction with a roller, a conveying member, etc. would occur during a sheet discharging step after fixation, before the molecular mobility is arrested sufficiently, which is unfavorable because scars might be generated on the surface of an image or the glossiness of the image might be changed.

It is more preferable if the value of t50 of the toner is smaller. However, the lower limit thereof may be 0.01 msec. or greater.

It is more preferable if the value of t130 of the toner is larger. However, the upper limit thereof may be 35 msec. or less.

It is more preferable if the value of t'70 of the toner is smaller. However, the lower limit thereof may be 0.50 msec. or greater.

<<Measuring Method Using Pulse Method NMR>>

This measurement can be performed with "MINISPEC-MQ20" manufactured by Bruker Optics K.K. In Examples to be described below, which are the embodiments of the present invention, the following method was performed for the measurement, with the instruments described above. The measurement was performed for a 1H nucleus as the observation target, under the conditions of a resonance frequency of 19.65 MHz and measuring intervals of 5 s. The solid echo method was used for t50, and the Hahn echo method was used for the others with a pulse sequence (90° x-Pi-180° x) to thereby measure a decay curve. Note that the measurement was performed for a total of 32 times by changing the temperature from 50° C. to 130° C. and from 130° C. to 70° C., with Pi of from 0.01 msec. to 100 msec. and with the number of data points being 100 points.

As a sample, a toner powder (0.2 g) was put into a dedicated sample tube, and inserted into the sample tube until it reached within an appropriate range of a magnetic field for measurement. Through this measurement, the spin-spin relaxation time (t50) at 50° C., the spin-spin relaxation time (t130) at 130° C., and the spin-spin relaxation time (t'70) at 70° C. when cooled from 130° C. to 70° C. were obtained for each sample.

In the measurement of t50, a hard component with a short relaxation time was the component of interest, and hence measurement by the solid echo method that focuses on a hard component was suitable.

In the measurement of t130, the mobility of the system on the whole was the target of interest, and in the measurement of t'70, arresting of the mobility of the system on the whole when cooled was the target of interest. Therefore, measurement by the Hahn echo method that focuses on a soft component with a long relaxation time was suitable.

<Characteristics Required in AFM>

As for the toner, a binarized image of the toner, which is obtained by binarizing a phase image of the toner observed by a tapping mode AFM based on the intermediate value between the maximum value and the minimum value of the phase difference in the phase image includes first phase difference images constituted by portions having a large phase difference and a second phase difference image constituted by a portion having a small phase difference. The first phase difference images are dispersed in the second phase difference image, and the dispersion diameter, in the dispersal phase, of the first phase difference images constituted by the portions having a large phase difference is 150 nm or less, and preferably from 10 nm to 100 nm.

In the present invention, when the first phase difference images are dispersed in the second phase difference image, it means that boundaries can be defined between domains in the binarized image, and that a ferre diameter of the first phase difference images in the dispersal phase can be specified. When the first phase difference images in the binarized image represent minute particle diameters which are difficult to discriminate between an image noise or a phase difference image, or when a clear ferre diameter cannot be specified for the first phase difference images, the first phase difference images are judged as "not being dispersed". A ferre diameter cannot be specified for the first phase difference images, when they are buried in image noise and hence domain boundaries cannot be defined. Example shapes of the first phase difference images for which a ferre diameter can be specified include a dot shape and a cyclic structure. Examples of the cyclic structure include a stratal structure represented by a columnar structure, and a mille-feuille structure.

Only when the domain shape is a stripe and the maximum ferre diameter is 300 nm or greater, the minimum ferre diameter is used as the domain diameter instead of the maximum ferre diameter.

In order to improve the toughness of the binder resin, it is necessary to incorporate into the resin, a structure for relaxing external deformation and pressure. Example means for this include incorporating a softer structure. However, in this case, blocking caused by melting adhesion of toner particles during storage, and damages to an image or adhesion to an image due to the softness would be more likely to occur. In order to balance between toughness and relaxation, it is necessary to overcome this trade-off relationship between both of these.

The present inventors have discovered that the trade-off relationship between resin toughness enhancement and relaxation can be overcome by minutely dispersing the first phase difference images constituted by portions having a large phase difference, which would enhance the toughness by effectively acting on stress relaxation, in the phase of the second phase difference image constituted by a portion having a small phase difference.

<<Measuring Method with AFM>>

An internal dispersal state of a toner can be confirmed from a phase image obtained by tapping mode with an atomic force microscope (AFM). Tapping mode with an atomic force microscope is a method described in Surface Science Letter, 290, 668 (1993). This method measures the shape of the surface of a sample by vibrating a cantilever as described in Macromolecules, 28, 6773 (1995). At this time, a phase difference is generated between a drive, which is the vibration source of the cantilever, and the actual vibration, depending on the viscoelastic characteristic of the surface of the sample. This phase difference is mapped as a phase image. Soft portions are observed with a large phase delay, whereas hard portions are observed with a small phase delay.

In the toner, it is preferable that portions that are soft and observed as images having a large phase difference be minutely dispersed in a portion that is hard and observed as an image having a small phase difference. In this case, it is preferable that the first phase difference images, which are constituted by the soft portions having a large phase difference, be minutely dispersed as an internal phase in the second phase difference image, which is constituted by the hard portion having a small phase difference as an external phase.

In Examples to be described below, which are the embodiments of the present invention, the AFM measurement was performed with the following instrument according to the following method.

As the sample from which to obtain the phase image, a block of a toner was cut out as a section with an ultra microtome ULTRACUT UCT manufactured by Leica. This section was used for observation.

Cutting thickness: 60 nm

Cutting speed: 0.4 mm/sec

With the use of a diamond knife (ULTRA SONIC 35°)

A representative instrument for obtaining the AFM phase image is, for example, MFP-3D manufactured by Asylum Technology. A cantilever may be, for example, OMCL-AC240TS-C3. The instrument mentioned above was used in Examples. The following measurement conditions were used for observation.

Target amplitude: 0.5 V

Target percent: −5%

Amplitude setpoint: 315 mV

Scan rate: 1 Hz

Scan points: 256×256

Scan angle: 0°

Figure 3:
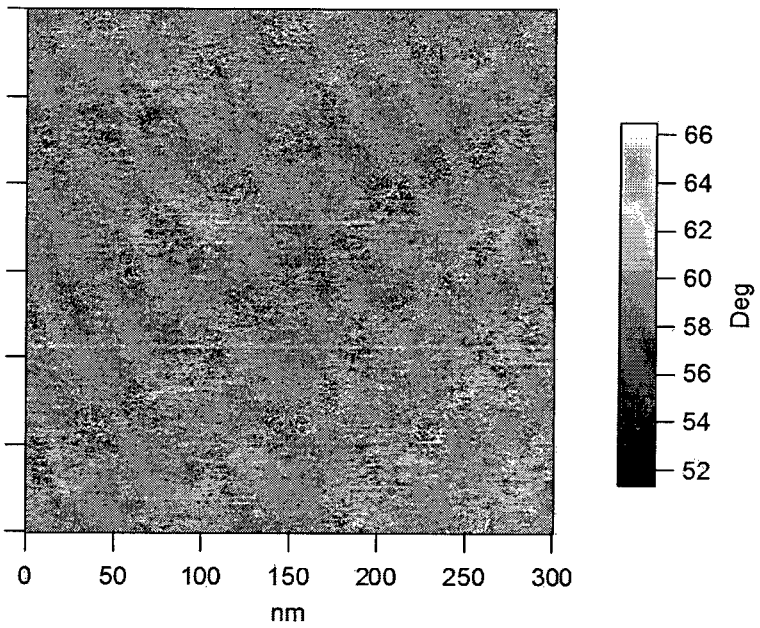
FIG. 3 is an example minute diameter image that is difficult to discriminate between an image noise or a phase difference image.

In a specific method for measuring the average of the maximum ferre diameters of the first phase difference images (i.e., the soft units) constituted by the portions having a large phase difference in the phase image obtained by AFM, the phase image obtained by a tapping mode AFM is binarized based on an intermediate value between the maximum value of the phase difference in the phase image and the minimum value of the phase difference in the phase image, to thereby generate a binarized image. The binarized image is obtained by, as described above, capturing a phase image to have a contrast between portions having a small phase difference, which are expressed with a deep color, and portions having a large phase difference, which are expressed with a light color, and after this, binarizing the phase image by regarding the intermediate value between the maximum value of the phase difference in the phase image and the minimum value of the phase difference in the phase image as a boundary. From 10 images included within a 300 nm square range in the binarized image, 30 first phase difference images with the largest maximum ferre diameters are selected in the descending order, and the average of these diameters is used as the average of the maximum ferre diameters. Here, any image with a minute diameter (see FIG. 3) that will definitely be judged as an image noise, or that is difficult to discriminate between an image noise or a phase difference image, is excluded from calculation of the average diameter. Specifically, any first phase difference image that is present on the same image on which the first phase difference image having the largest maximum ferre diameter is present and that has an area ratio of 1/100 or less relative to this first phase difference image is not to be used for calculation of the average diameter. The maximum ferre diameter is the distance between two parallel lines, which measures the largest when a phase difference image is sandwiched between two parallel lines.

Figure 2:
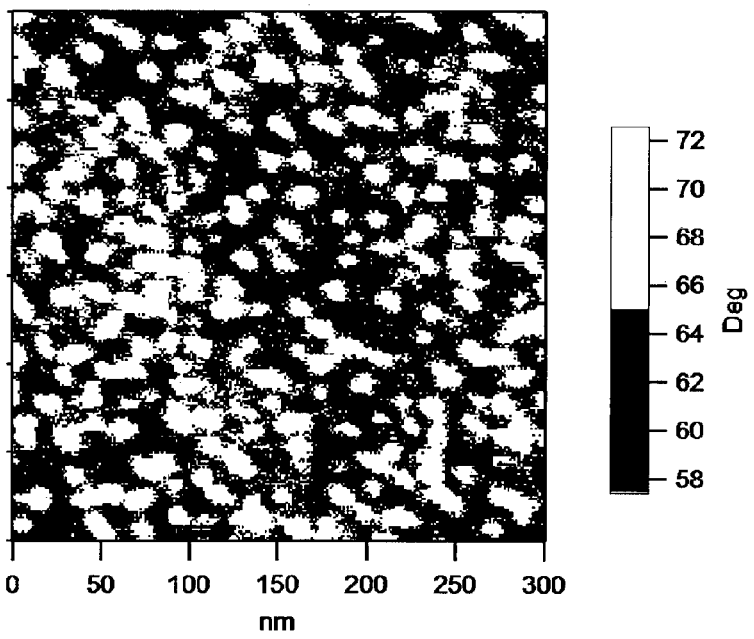
FIG. 2 is a binarized image obtained by binarizing the phase image of FIG. 1.

For reference, FIG. 1 shows a phase image of a block copolymer resin of Manufacture Example 3-1. FIG. 2 shows a binarized image obtained by binarizing this phase image in the manner described above. In FIG. 2, bright regions are the first phase difference images (images having a large phase difference) constituted by portions having a large phase difference, and a dark region is the second phase difference image (an image having a small phase difference) constituted by a portion having a small phase difference.

Only when the domain shape is a stripe and the maximum ferre diameter is 300 nm or greater, the minimum ferre diameter is used as the domain diameter instead of the maximum ferre diameter.

<Molecular Weight of Copolymer Resin>

The weight average molecular weight (Mw) of the copolymer resin is preferably from 20,000 to 150,000 in order to satisfy the various characteristics described above and realize both of low temperature fixability and heat resistant storage stability.

When w is less than 20,000, the heat resistant storage stability of the toner might degrade, and the hot offset resistance thereof might also degrade. When Mw is greater than 150,000, the toner might not melt sufficiently during fixation at a low temperature, which would make it easier for the image to be peeled off, leading to degradation of the low temperature fixability of the toner.

Mw can be measured with a gel permeation chromatography (GPC) measuring instrument (e.g., HLC-8220GPC (manufactured by Tosoh Corporation)). In Examples to be described later, which are the embodiments of the present invention, Mw was measured by the following method with the instrument mentioned above. As the column, a 15 cm three-serial column TSKGEL SUPER HZM-H (manufactured by Tosoh Corporation) was used. The resin to be measured was prepared as a 0.15% by mass solution of tetrahydrofuran (THF) (containing a stabilizer, manufactured by Wako Pure Chemical Industries, Ltd.), and the obtained solution was filtrated through a 0.2 μm filter. The resulting filtrate was used as the sample. The THF sample solution (100 μL) was poured into the measuring instrument, and measured at a temperature of 40° C. at a flow rate of 0.35 mL/min.

Calculation of the molecular weight was performed with the use of a standard curve that was generated based on monodisperse polystyrene standard samples. As the monodisperse polystyrene standard samples, SHOWDEX STANDARD series manufactured by Showa Denko K.K. and toluene were used. THF solutions of the following three kinds of monodisperse polystyrene standard samples were prepared and measured on the conditions described above. With the retention time of a peak top regarded as the light-scattering molecular weight of the monodisperse polystyrene standard samples, a standard curve was generated.

Solution A: S-7450 (2.5 mg), S-678 (2.5 mg), S-46.5 (2.5 mg), S-2.90 (2.5 mg), THF (50 mL)

Solution B: S-3730 (2.5 mg), S-257 (2.5 mg), S-19.8 (2.5 mg), S-0.580 (2.5 mg), THF (50 mL)

Solution C: S-1470 (2.5 mg), S-112 (2.5 mg), S-6.93 (2.5 mg), toluene (2.5 mg), THF (50 mL)

As the detector, a RI (refraction index) detector was used.

<Method for Manufacturing Toner>

The method for manufacturing the toner is not particularly limited and may be appropriately selected according to the purpose. Examples thereof include wet granulation method and pulverization method. Examples of the wet granulation method include dissolution suspension method and emulsion agglomeration method. The dissolution suspension method and the emulsion agglomeration method are preferable because these are manufacturing methods that do not include kneading of the binder resin, because the molecules might be disrupted by kneading and because of the difficulty with uniformly kneading a high molecular weight resin and a low molecular weight resin. The dissolution suspension method is more preferable in terms of uniformity of the resin in the toner particles.

The toner can also be manufactured by a particle manufacturing method described in JP-B No. 4,531,076, i.e., a particle manufacturing method of dissolving the materials of the toner in carbon dioxide in a liquid state or a supercritical state, and after this, removing the carbon oxide in this liquid state or supercritical state, to thereby obtain toner particles.

—Dissolution Suspension Method—

An example method of the dissolution suspension method includes a toner material phase preparing step, an aqueous medium phase preparing step, an emulsion or dispersion liquid preparing step, and an organic solvent removing step, and according to necessity, other steps.

——Toner Material Phase (Oil Phase) Preparing Step——

The toner material phase preparing step is not particularly limited and may be appropriately selected according to the purpose, as long as it is a step of dissolving or dispersing in an organic solvent, toner materials that include at least the binder resin, and according to necessity, the colorant, the releasing agent, etc., to thereby prepare a dissolved or dispersed liquid (may also be referred to as a toner material phase or an oil phase) of the toner materials.

The organic solvent is not particularly limited and may be appropriately selected according to the purpose. However, it is preferably a volatile solvent having a boiling point of lower than 150° C., because such a solvent is easy to remove.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Among these, preferred are ethyl acetate, toluene, xylene, benzene, methylene chloride, 1,2-dichloroethane, chloroform, and carbon tetrachloride, and more preferred is ethyl acetate.

One of these may be used alone, or two or more of these may be used in combination.

The amount of the organic solvent to be used is not particularly limited and may be appropriately selected according to the purpose. However, it is preferably from 0 part by mass to 300 parts by mass, more preferably from 0 part by mass to 100 parts by mass, and particularly preferably from 25 parts by mass to 70 parts by mass relative to 100 parts by mass of the toner materials.

——Aqueous Medium Phase (Aqueous Phase) Preparing Step——

The aqueous medium phase preparing step is not particularly limited and may be appropriately selected according to the purpose, as long as it is a step of preparing an aqueous medium phase. In this step, it is preferable to prepare an aqueous medium phase that contains resin fine particles in an aqueous medium.

The aqueous medium is not particularly limited and may be appropriately selected according to the purpose. Examples thereof include water, a solvent miscible with water, and mixtures thereof. Among these, water is particularly preferable.

The solvent miscible with water is not particularly limited and may be appropriately selected according to the purpose, as long as it is miscible with water. Examples thereof include alcohol, dimethylformamide, tetrahydrofuran, cellosolves, and lower ketones.

Examples of the alcohol include methanol, isopropanol, and ethylene glycol.

Examples of the lower ketones include acetone and methyl ethyl ketone.

One of these may be used alone, or two or more of these may be used in combination.

Preparation of the aqueous medium phase is performed by, for example, dispersing the resin fine particles in the aqueous medium in the presence of a surfactant. The surfactant and the resin fine particles are added appropriately to the aqueous medium, with a view to improving dispersion of the toner materials.

The additive amounts of the anionic surfactant and the resin fine particles are not particularly limited and may be appropriately selected according to the purpose. However, both are preferably from 0.5% by mass to 10% by mass relative to the aqueous medium.

The surfactant is not particularly limited and may be appropriately selected according to the purpose. Examples thereof include an anionic surfactant, a cationic surfactant, and an amphoteric surfactant.

Examples of the anionic surfactant include fatty acid salts, alkyl sulfuric ester salts, alkyl aryl sulfonic acid salts, alkyl diaryl ether disulfonic acid salts, dialkyl sulfosuccinic acid salts, alkyl phosphoric acid salts, naphthalene sulfonic acid-formalin condensate, polyoxyethylene alkyl phosphoric acid ester salts, and glycerol borate fatty acid esters.

Any resin can be used as the resin fine particles as long as the resin can form an aqueous dispersion, and such a resin may be a thermoplastic resin or a thermosetting resin. Example materials of the resin fine particles include a vinyl-based resin, a polyurethane resin, an epoxy resin, a polyester resin, a polyamide resin, a polyimide resin, a silicon-based resin, a phenol resin, a melamine resin, a urea resin, an aniline resin, an ionomer resin, and a polycarbonate resin. One of these may be used alone, or two or more of these may be used in combination.

Among these, a vinyl-based resin, a polyurethane resin, an epoxy resin, and a polyester resin, and any combinations among these are preferable, because an aqueous dispersion of fine spherical resin particles is easy to obtain from these.

The vinyl-based resin is a polymer produced through homopolymerization or copolymerization of vinyl monomers. Examples thereof include styrene-(meth)acrylate copolymers, styrene-butadiene copolymers, (meth)acrylic acid-acrylate polymers, styrene-acrylonitrile copolymers, styrene-maleic anhydride copolymers, and styrene-(meth) acrylic acid copolymers.

The average particle diameter of the resin fine particles is not particularly limited and may be appropriately selected according to the purpose. However, it is preferable from 5 nm to 200 nm, and more preferably from 20 nm to 300 nm.

In the preparation of the aqueous medium phase, cellulose may be used as a dispersant. Examples of the cellulose include methyl cellulose, hydroxyethyl cellulose, hydroxypropyl cellulose, and carboxymethyl cellulose sodium.

——Emulsion or Dispersion Liquid Preparing Step——

The emulsion or dispersion liquid preparing step is not particularly limited and may be appropriately selected according to the purpose, as long as it is a step of mixing the dissolved or dispersed liquid of the toner materials (toner material phase) with the aqueous medium phase to emulsify or disperse it therein to thereby prepare an emulsion or dispersion liquid.

The emulsifying or dispersion method is not particularly limited and may be appropriately selected according to the purpose. For example, a publicly known disperser may be used. Examples of the disperser include a low-speed shearing disperser and a high-speed shearing disperser.

The amount of the aqueous medium phase to be used relative to 100 parts by mass of the toner material phase is not particularly limited and may be appropriately selected according to the purpose. However, it is preferably from 50 parts by mass to 2,000 parts by mass, and more preferably from 100 parts by mass to 1,000 parts by mass. When the amount of use is less than 50 parts by mass, the toner material phase would be ill dispersed, making it impossible to obtain toner particles with a predetermined particle diameter. When the amount of use is greater than 2,000 parts by mass, it is not economical.

——Organic Solvent Removing Step——

The organic solvent removing step is not particularly limited and may be appropriately selected according to the purpose, as long as it is a step of removing the organic solvent from the emulsion or dispersion liquid to thereby obtain a desolventized slurry.

The methods for removing the organic solvent include (1) a method of elevating the temperature of a whole reaction system gradually to completely vaporize and remove the organic solvent in the oil droplets of the emulsion or dispersion liquid, and (2) a method of spraying the emulsion or dispersion liquid to a drying atmosphere to completely remove the organic solvent in the oil droplets of the emulsion or dispersion liquid. When the organic solvent is removed, toner particles are formed.

——Other Steps——

The other steps include, for example, a washing step and a drying step.

———Washing Step———

The washing step is not particularly limited and may be appropriately selected according to the purpose, as long as it is a step of washing the desolventized slurry with water. Examples of the water include ion-exchanged water.

———Drying Step———

The drying step is not particularly limited and may be appropriately selected according to the purpose, as long as it is a step of drying the toner particles obtained in the washing step.

—Pulverization Method—

The pulverization method is a method for manufacturing base particles of the toner by pulverizing and classifying a melted and kneaded product of the toner materials that contain at least the binder resin.

The melting and kneading is performed by charging a melt kneader with a mixture obtained by mixing the toner materials. Examples of the melt kneader include a uniaxial or biaxial continuous kneader, and a batch kneader with a roll mill. Specific examples include KTK TYPE BIAXIAL EXTRUDER manufactured by Kobe Steel Ltd., TEM TYPE EXTRUDER manufactured by Toshiba Machine Co., Ltd., BIAXIAL EXTRUDER manufactured by KCK, PCM TYPE BIAXIAL EXTRUDER manufactured by Ikegai Corp., and CO-KNEADER manufactured by Buss Inc. It is preferable to perform this melting and kneading under appropriate conditions so as not to bring about disruption of molecular chains of the binder resin. Specifically, the melting and kneading temperature is set based on the softening point of the binder resin. If the temperature is much higher than the softening point, disruption will be heavy. If the temperature is much lower than the melting point, dispersion might not progress.

The pulverization is a step of pulverizing a kneaded product obtained by the melting and kneading. In this pulverization, it is preferable to pulverize the kneaded product coarsely first, and then pulverize it finely. For this, a method of pulverizing the kneaded product by making it collide on a collision plate in a jet air stream, a method of pulverizing the kneaded product by making the particles themselves collide on each other in a jet air stream, and a method of pulverizing the kneaded product between a small gap between a mechanically rotating rotor and a stator are preferably used.

The classification is a step of adjusting the pulverized product obtained by the pulverization to particles of a predetermined particle diameter. The classification can be performed by removing fine particles with, for example, a cyclone, a decanter, and a centrifuge.

(Developer)

A developer of the present invention contains the toner of the present invention. The developer may be a one-component developer or a two-component developer mixed with a carrier. Of these, the two-component developer is preferable in terms of life extending, when used for a high-speed printer or the like that is adapted to increased information processing speed of recent years.

With the one-component developer using the toner, the particle diameter of the toner does not so much fluctuate through toner supply and consumption, and favorable and stable developing performance and image can be obtained even against a long time of use (stirring) of the developing unit, because there would occur no filming of the toner to the developing roller or no melting adhesion of the toner to a layer thickness regulating member such as a blade for thinning the toner into a thin layer.

With the two-component developer using the toner, the particle diameter of the toner particles in the developer does not so much fluctuate through toner supply and consumption, and favorable and stable developing performance can be obtained even against a long time of stirring by the developing unit.

<Carrier>

The carrier is not particularly limited and may be appropriately selected according to the purpose. However, a preferable carrier contains a core material, and a resin layer coating the core material.

<<Core Material>>

The core material is not particularly limited and may be appropriately selected according to the purpose, as long as it is particles having a magnetic property. However, preferable examples thereof are ferrite, magnetite, iron, and nickel. With remarkably increasing concern for adaptability to environmental aspects in recent years, preferable as the ferrite are manganese ferrite, manganese-magnesium ferrite, manganese-strontium ferrite, manganese-magnesium-strontium ferrite, and lithium-based ferrite, instead of the conventional copper-zinc-based ferrite.

<<Resin Layer>>

The material of the resin layer is not particularly limited and may be appropriately selected according to the purpose. Examples thereof include amino-based resin, polyvinyl-based resin, polystyrene-based resin, halogenated olefin resin, polyester-based resin, polycarbonate-based resin, polyethylene resin, polyvinyl fluoride resin, polyvinylidene fluoride resin, polytrifluoroethylene resin, polyhexafluoropropylene resin, copolymer of vinylidene fluoride and acrylic monomer, copolymer of vinylidene fluoride and vinyl fluoride, fluoro-terpolymer such as terpolymer of tetrafluoroethylene, vinylidene fluoride, and non-fluorinated monomer, and silicone resin. One of these may be used alone, or two or more of these may be used in combination.

The silicone resin is not particularly limited and may be appropriately selected according to the purpose. Examples thereof include: straight silicone resin that is made only of organosiloxane bonds; and modified silicone resin that is modified with alkyd resin, polyester resin, epoxy resin, acrylic resin, urethane resin, or the like.

Commercially-available products may be used as the silicone resin.

Example commercially-available products of the straight silicone resin include KR271, KR255, and KR152 manufactured by Shin-Etsu Chemical Co., Ltd.; and SR2400, SR2406, and SR2410 manufactured by Dow Corning Toray Silicone Co., Ltd.

Example commercially-available products of the modified silicone resin include KR206 (alkyd modified-silicone resin), KR5208 (acrylic modified-silicone resin), ES1001N (epoxy modified-silicone resin), and KR305 (urethane modified-silicone resin) manufactured by Shin-Etsu Chemical Co., Ltd.; and SR2115 (epoxy modified-silicone resin) and SR2110 (alkyd modified-silicone resin) manufactured by Dow Corning Toray Silicone Co., Ltd.

The silicone resin may be used alone, but may also be used in combination with a component that can cause a cross-linking reaction, a charge amount adjusting component, etc.

The content in the carrier, of the component to form the resin layer is preferably from 0.01% by mass to 5.0% by mass. When the content is less than 0.01% by mass, the resin layer may not be uniform on the surface of the core material. When the content is greater than 5.0% by mass, the resin layer would become so thick that carrier component would be granulated within itself, and hence uniform carrier particles may not be obtained.

When the developer is a two-component developer, the content of the toner is not particularly limited and may be appropriately selected according to the purpose. However, the content is preferably from 2.0 parts by mass to 12.0 parts by mass, and more preferably from 2.5 parts by mass to 10.0 parts by mass relative to 100 parts by mass of the carrier.

(Image Forming Apparatus and Image Forming Method)

An image forming apparatus of the present invention includes at least an electrostatic latent image bearing member (hereinafter may be referred to as "photoconductor"), an electrostatic latent image forming unit, and a developing unit, and includes other units such as a transfer unit and a fixing unit according to necessity.

An image forming method of the present invention includes at least a developing step, a transfer step, and a fixing step, preferably includes an electrostatic latent image forming step, and includes other steps according to necessity.

The image forming method may be preferably performed by the image forming apparatus. The electrostatic latent image forming step may be preferably performed by the electrostatic latent image forming unit. The developing step may be preferably performed by the developing unit. The transfer step may be preferably performed by the transfer unit. The fixing step may be preferably performed by the fixing unit. The other steps may be preferably performed by the other units.

<Electrostatic Latent Image Bearing Member>

The electrostatic latent image bearing member is not particularly limited in terms of material, structure, and size, and may be appropriately selected from publicly known bearing members. In terms of material, there are inorganic photoconductors made of, for example, amorphous silicone and selenium, and organic photoconductors made of, for example, polysilane and phthalopolymethine. Among these, amorphous silicon is preferable in terms of long life.

As the amorphous silicon photoconductor, it is possible to use a photoconductor that contains a photoconductive layer made of a-Si, which is manufactured by heating a support member to 50° C. to 400° C., and forming the photoconductive layer on the support member by film forming method such as vacuum vapor deposition, sputtering, ion plating, thermal CVD (chemical vapor deposition), optical CVD, and plasma CVD. Among these, plasma CVD, i.e., a method of decomposing a material gas under a direct current, or under a high-frequency or microwave glow discharge to thereby form an a-Si deposited film on the support member is preferable.

The shape of the electrostatic latent image bearing member is not particularly limited and may be appropriately selected according to the purpose. However, a cylindrical shape is preferable. The outer diameter of the electrostatic latent image bearing member having the cylindrical shape is not particularly limited and may be appropriately selected according to the purpose. However, it is preferably from 3 mm to 100 mm, more preferably from 5 mm to 50 mm, and particularly preferably from 10 mm to 30 m.

<Electrostatic Latent Image Forming Unit and Electrostatic Latent Image Forming Step>

The electrostatic latent image forming unit is not particularly limited and may be appropriately selected according to the purpose, as long as it is a unit configured to form an electrostatic latent image on the electrostatic latent image bearing member. An example electrostatic latent image forming unit includes at least a charging member configured to electrically charge the surface of the electrostatic latent image bearing member, and an exposing unit configured to expose the surface of the electrostatic latent image bearing member to light imagewise.

The electrostatic latent image forming step is not particularly limited and may be appropriately selected according to the purpose as long as it is a step of forming an electrostatic latent image on the electrostatic latent image bearing member. For example, this step may be performed by electrically charging the surface of the electrostatic latent image bearing member, and after this, exposing the surface to light imagewise, and may be performed by the electrostatic latent image forming unit.

<<Charging Member and Charging>>

The charging member is not particularly limited and may be appropriately selected according to the purpose. Examples thereof include: a publicly known contact type charger that includes a conductive or semi-conductive roller, a brush, a film, a rubber blade, etc.; and a contactless charger that utilizes corona discharge, such as a corotron and a scorotron.

The charging can be performed by, for example, applying a voltage to the surface of the electrostatic latent image bearing member with the charging member.

The shape of the charging member may be anything, such as of a roller, a magnetic brush, and a fur brush, and may be selected according to the specifications and configuration of the image forming apparatus.

When the magnetic brush is used as the charging member, the magnetic brush is constituted as a charging member that is made of particles of any of various kinds of ferrites such as Zn—Cu ferrite, and that includes a non-magnetic electroconductive sleeve on which the ferrite particles are supported, and a magnet roll enclosed within the sleeve.

When the fur brush is used as the charging member, the material of the fur brush may be a fur that is treated with carbon, copper sulfide, metal, or metal oxide to have electroconductivity, and that is wounded around or pasted onto a cored bar treated with metal or any other substance to have electro-conductivity, to be thereby constituted as a charging member.

The charging member is not limited to the contact type charging member. However, use of a contact type charging member is preferable, because an image forming apparatus with reduced ozone to be generated from a charging member can be obtained.

<<Exposing Unit and Exposure>>

The exposing unit is not particularly limited and may be appropriately selected according to the purpose as long as it can expose the surface of the electrostatic latent image bearing member charged by the charging member to light imagewise like the image to be formed. Examples thereof include exposing units of a copier optical system, a rod lens array system, a laser optical system, a liquid crystal shutter optical system, etc.

The light source used for the exposing unit is not particularly limited and may be appropriately selected according to the purpose. Examples thereof include light emitting materials of all kinds such as a fluorescent lamp, a tungsten lamp, a halogen lamp, a mercury lamp, a sodium-vapor lamp, a light emitting diode (LED), a laser diode (LD), and electroluminescence (EL).

In order to apply light of only a desired wavelength range, it is possible to use various kinds of filters such as a sharp cut filter, a band pass filter, a near infrared cut filter, a dichroic filter, an interference filter, and a color temperature conversion filter.

The exposure can be performed by exposing the surface of the electrostatic latent image bearing ember to light imagewise with the exposing unit.

In the present invention, it is also possible to employ a backlight system configured to expose the electrostatic latent image bearing member to light imagewise from the back side of the bearing member.

<Developing Unit and Developing Step>

The developing unit is not particularly limited and may be appropriately selected according to the purpose, as long as it is a developing unit containing a toner and configured to develop the electrostatic latent image formed on the electrostatic latent image bearing member to form a visible image.

The developing step is not particularly limited and may be appropriately selected according to the purpose, as long as it is a step of developing the electrostatic latent image formed on the electrostatic latent image bearing member with a toner to form a visible image, and may be performed with, for example, the developing unit.

The developing unit may be of a dry developing system, or of a wet developing system. Further, it may be a single-color developing unit or a multi-color developing unit.

Preferable as the developing unit is a developing device that includes a stirrer configured to friction and stir the toner to electrically charge the toner, and a developer bearing member that internally includes a fixed magnetic field generating unit and that is rotatably by bearing on the surface thereof a developer containing the toner.

Within the developing unit, for example, the toner and the carrier are mixed and stirred, causing friction to electrically charge the toner, which is thus retained on the surface of a rotating magnet roller in a chain-like form to thereby form a magnetic brush. Because the magnet roller is provided near the electrostatic latent image bearing member, the toner constituting the magnetic brush formed on the surface of the magnet roller is partially removed to the surface of the electrostatic latent image bearing member under an electric attractive force. As a result, the electrostatic latent image is developed with the toner to thereby form a visible image made of the toner on the surface of the electrostatic latent image bearing member.

<Other Units and Other Steps>

The other units include, for example, a transfer unit, a fixing unit, a cleaning unit, a diselectrifying unit, a recycling unit, and a control unit.

The other steps include, for example, a transfer step, a fixing step, a cleaning step, a diselectrifying step, a recycling step, and a control step.

<<Transfer Unit and Transfer Step>>

The transfer unit is not particularly limited and may be appropriately selected according to the purpose, as long as it is a unit configured to transfer a visible image onto a recording medium. A preferable transfer unit includes a first transfer unit configured to transfer a visible image onto an intermediate transfer member to form a composite transfer image, and a second transfer unit configured to transfer the composite transfer image onto a recording medium.

The transfer step is not particularly limited and may be appropriately selected according to the purpose, as long as it is a step of transferring a visible image onto a recording medium. A preferable transfer step includes using an intermediate transfer member to perform a first transfer of transferring a visible image onto the intermediate transfer member, and performing a second transfer of transferring the visible image onto the recording medium.

The transfer step can be performed by electrically charging the photoconductor with a transfer charger to transfer the visible image, and may be performed with the transfer unit.

When the image to be secondly transferred to the recording medium is a color image to be made of plural colors of toners, the transfer unit can sequentially overlay the toners of the respective colors on the intermediate transfer member to form an image on the intermediate transfer member, so that the intermediate transfer member can secondly transfer the image on the intermediate transfer member onto the recording medium simultaneously.

The intermediate transfer member is not particularly limited and may be appropriated selected according to the purpose from publicly known transfer members. A preferable example thereof is a transfer belt.

The transfer unit (including the first transfer unit and the second transfer unit) preferably includes at least a transfer device configured to electrically charge the visible image formed on the photoconductor to be separated onto the recording medium. Examples of the transfer device include a corona transfer device utilizing a corona discharge, a transfer belt, a transfer roller, a pressure transfer roller, and an adhesive transfer device.

The recording medium is representatively regular paper, but is not particularly limited and may be appropriately selected according to the purpose, as long as it can have a developed unfixed image transferred thereonto. Examples thereof include a PET base for OHP.

<<Fixing Unit and Fixing Step>>

The fixing unit is not particularly limited and may be appropriately selected according to the purpose, as long as it is a unit configured to fix a transfer image transferred onto the recording medium thereon. However, it is preferably a publicly-known heating pressurizing member. Examples of the heating pressurizing member include a combination of a heating roller and a pressurizing roller, and a combination of a heating roller, a pressurizing roller, and an endless belt.

The fixing step is not particularly limited and may be appropriately selected according to the purpose, as long as it is a step of fixing a visible image transferred onto the recording medium thereon. For example, the fixing step may be performed each time a toner of a given color is transferred onto the recording medium, or may be performed at a time simultaneously onto the toners of the respective colors that are overlaid.

The fixing step may be performed with the fixing unit. The heating pressurizing member may preferably heat to, normally 80° C. to 200° C.

In the present invention, together with or instead of the fixing unit, for example, a publicly-known optical fixing device may be used according to the purpose.

The surface pressure in the fixing step is not particularly limited and may be appropriately selected according to the purpose. However, it is preferably from 10 $N/cm^2$ to 80 $N/cm^2$.

<<Cleaning Unit and Cleaning Step>>

The cleaning unit is not particularly limited and may be appropriately selected according to the purpose, as long as it is a unit capable of removing the toner remained on the photoconductor. Examples thereof include a magnetic brush cleaner, an electrostatic brush cleaner, a magnetic roller cleaner, a blade cleaner, a brush cleaner, and a web cleaner.

The cleaning step is not particularly limited and may be appropriately selected according to the purpose, as long as it is a step capable of removing the toner remained on the photoconductor. The cleaning step may be performed with, for example, the cleaning unit.

<<Diselectrifying Unit and Diselectrifying Step>>

The diselectrifying unit is not particularly limited and may be appropriately selected according to the purpose, as long as it is a unit configured to diselectrify the photoconductor by applying a diselectrifying bias thereto. Examples thereof include a charge removing lamp.

The diselectrifying step is not particularly limited and may be appropriately selected according to the purpose, as long as it is a step of diselectrifying the photoconductor by applying a diselectrifying bias thereto. The diselectrifying step may be performed with, for example, the diselectrifying unit.

<<Recycling Unit and Recycling Step>>

The recycling unit is not particularly limited and may be appropriately selected according to the purpose, as long as it is a unit configured to recycle the toner removed in the cleaning step to the developing device. Examples thereof include a publicly-known conveying unit.

The recycling step is not particularly limited and may be appropriately selected according to the purpose, as long as it is a step of recycling the toner removed in the cleaning step to the developing device.

The recycling step may be performed with, for example, the recycling unit.

<<Control Unit and Control Step>>

The control unit is not particularly limited and may be appropriately selected according to the purpose, as long as it is a unit capable of controlling the operations of the respective units. Examples thereof include devices such as a sequencer and a computer.

The control step is not particularly limited and may be appropriately selected according to the purpose, as long as it is a step of controlling the operations in the respective steps. The control step may be performed with, for example, the control unit.

Next, a mode of practicing a method of forming an image with the image forming apparatus of the present invention will be explained with reference to FIG. 4. An image forming apparatus 100 shown in FIG. 4 includes an electrostatic latent image bearing member 10, a charging roller 20 as the charging member, an exposing device 30 as the exposing unit, a developing device 40 as the developing unit, an intermediate transfer member 50, a cleaning device 60 as the cleaning unit including a cleaning blade, and a charge removing lamp 70 as the diselectrifying unit.

The intermediate transfer member 50 is an endless belt, and designed to be capable of being moved in the direction of the arrow by three rollers 51 that are provided inside the belt and over which the belt is tensed. Some of the three rollers 51 also function(s) as a transfer bias roller that can apply a predetermined transfer bias (a first transfer bias) to the intermediate transfer member 50. A cleaning device 90 including a cleaning blade is provided near the intermediate transfer member 50. A transfer roller 80 as the transfer unit, which is capable of applying a transfer bias for transferring (secondly transferring) a developed image (a toner image) onto a transfer sheet 95 as a recording medium, is also provided near the intermediate transfer member 50, facing the intermediate transfer member 50. A corona charger 58 configured to impart charges to a toner image on the intermediate transfer member 50 is provided on the circumference of the intermediate transfer member 50, at a middle location, in the rotating direction of the intermediate transfer member 50, between where the electrostatic latent image bearing member 10 and the intermediate transfer member 50 contact each other and where the intermediate transfer member 50 and the transfer sheet 95 contact each other.

The developing device 40 includes a developing belt 41 as the developer bearing member, and a black developing unit 45K, a yellow developing unit 45Y, a magenta developing unit 45M, and a cyan developing unit 45C, which are provided side by side on the circumference of the developing belt 41. The black developing unit 45K includes a developer container 42K, a developer supplying roller 43K, and a developing roller 44K. The yellow developing unit 45Y includes a developer container 42Y, a developer supplying roller 43Y, and a developing roller 44Y. The magenta developing unit 45M includes a developer container 42M, a developer supplying roller 43M, and a developing roller 44M. The cyan developing unit 45C includes a developer container 42C, a developer supplying roller 43C, and a developing roller 44C. The developing belt 41 is an endless belt, is tensed over a plurality of rollers rotatably, and partially contacts the electrostatic latent image bearing member 10.

Figure 4:
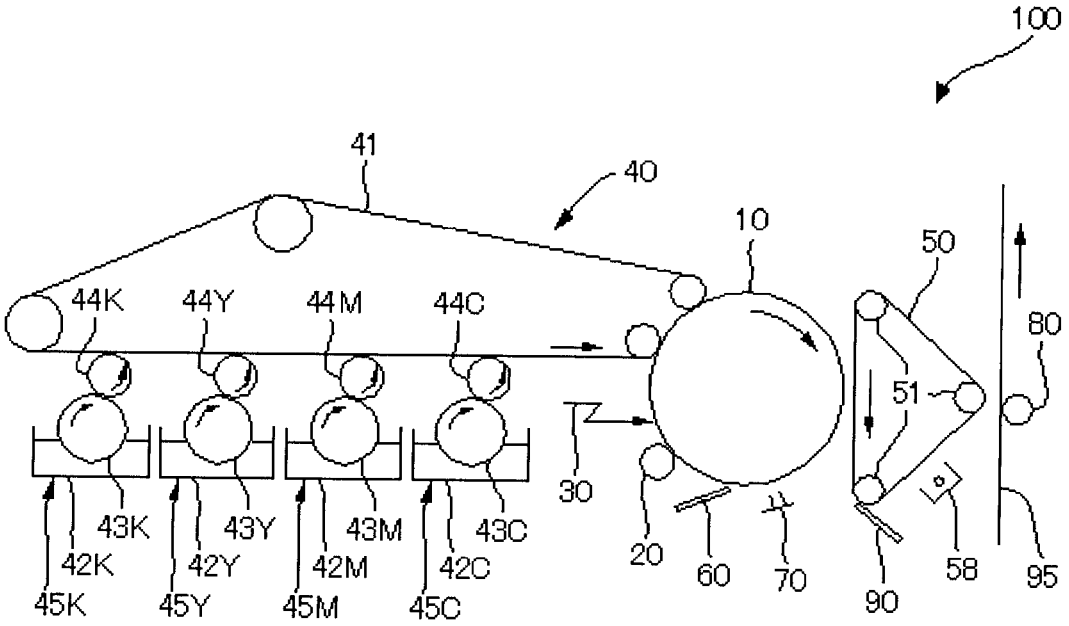
FIG. 4 is a schematic configuration diagram showing an example image forming apparatus of the present invention.

In the image forming apparatus 100 shown in FIG. 4, for example, the charging roller 20 electrically charges the electrostatic latent image bearing member 10 uniformly. The exposing device 30 applies light onto the electrostatic latent image bearing member 10 imagewise to form an electrostatic latent image thereon. The developer 40 supplies the toner to the electrostatic latent image formed on the electrostatic latent image bearing member 10 to develop the electrostatic latent image to thereby form a toner image. The toner image is transferred (firstly transferred) to the intermediate transfer member 50 under a voltage applied by the rollers 51, and then further transferred (secondly transferred) to the transfer sheet 95. As a result, a transfer image is formed on the transfer sheet 95. Any residual toner on the electrostatic latent image bearing member 10 is removed by the cleaning device 60, and the charges on the electrostatic latent image bearing member 10 are once removed by the charge removing lamp 70.

Figure 5:
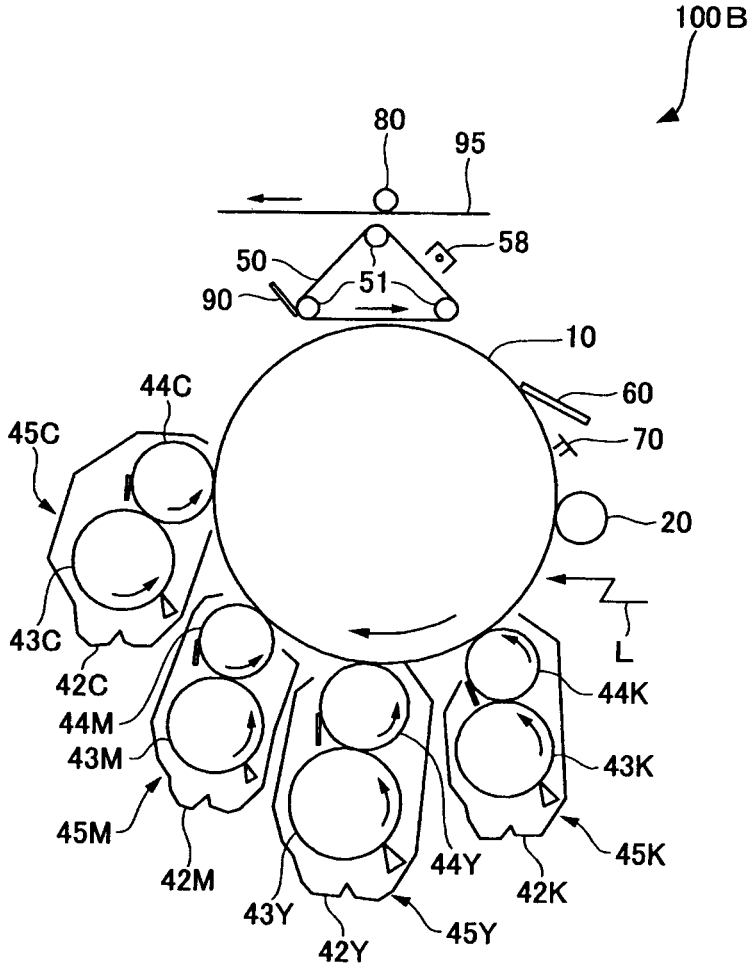
FIG. 5 is a schematic configuration diagram showing another example image forming apparatus of the present invention.

FIG. 5 shows another example of the image forming apparatus of the present invention. An image forming apparatus 100B has the same configuration as the image forming apparatus 100 shown in FIG. 4, except that it does not include the developing belt 41, but the black developing unit 45K, the yellow developing unit 45Y, the magenta developing unit 45M, and the cyan developing unit 45C are provided around the electrostatic latent image bearing member 10, directly facing the electrostatic latent image bearing member 10.

Figure 6:
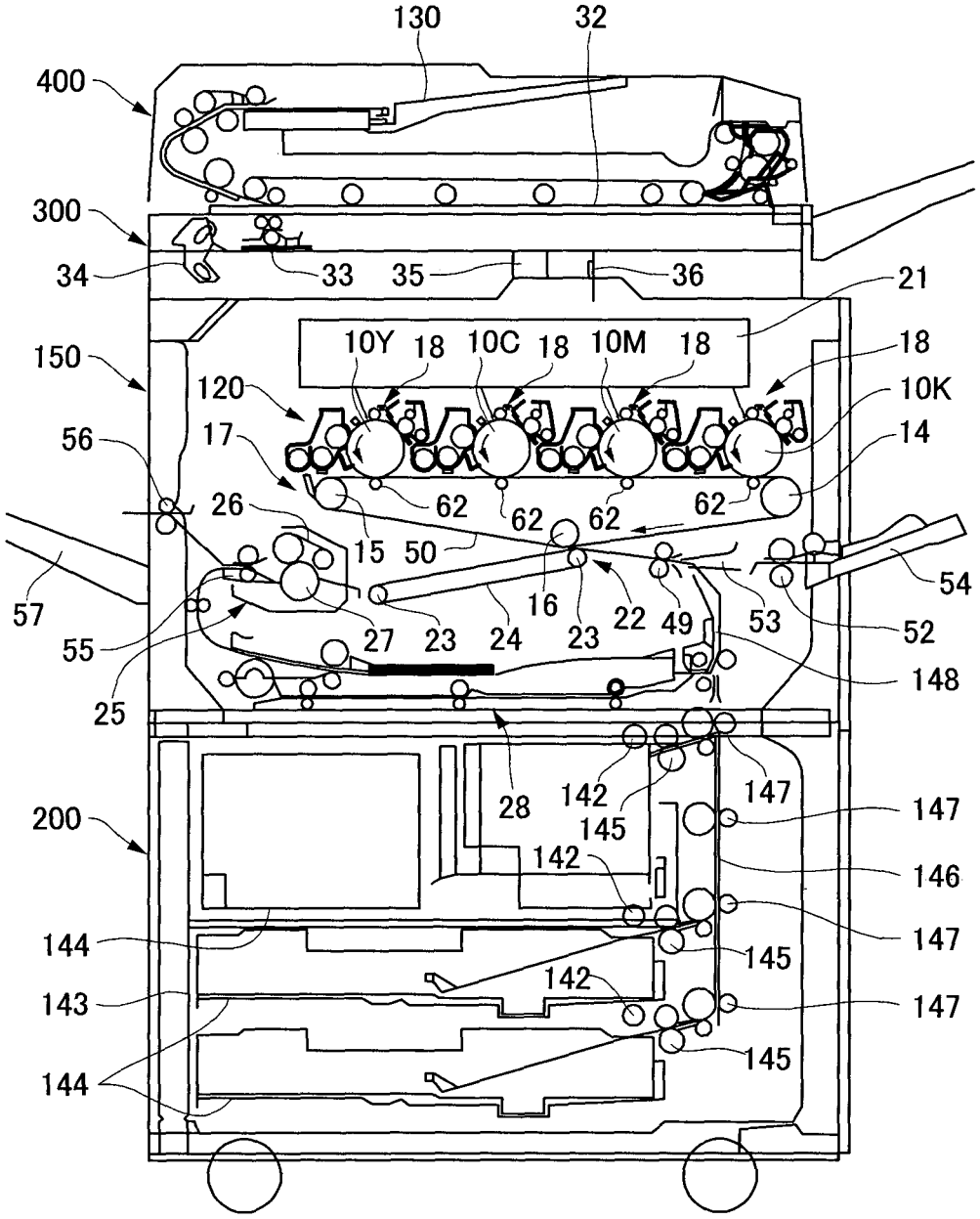
FIG. 6 is a schematic configuration diagram showing another example image forming apparatus of the present invention.

An image forming apparatus shown in FIG. 6 includes a copier body 150, a sheet feeding table 200, a scanner 300, and an automatic document feeder (ADF) 400.

The copier body 150 includes an endless belt-shaped intermediate transfer member 50 in the center portion thereof. The intermediate transfer member 50 is tensed over support rollers 14, 15, and 16, and is rotatable in the clockwise direction of FIG. 6. An intermediate transfer member cleaning device 17 configured to remove residual toner on the intermediate transfer member 50 is provided near the support roller 15. The intermediate transfer member 50 tensed by the support roller 14 and the support roller 15 is provided with a tandem developing device 120 that includes four image forming units 18 for yellow, cyan, magenta, and black, which face the intermediate transfer member 50 and are arranged side by side along the direction in which the intermediate transfer member 50 is conveyed. An exposing device 21 as the exposing unit is provided near the tandem developing device 120. A second transfer device 22 is provided on a side of the intermediate transfer member 50 that is opposite to the side thereof on which the tandem developing device 120 is provided. In the second transfer device 22, a second transfer belt 24, which is an endless belt, is tensed over a pair of rollers 23, and a transfer sheet conveyed over the second transfer belt 24 and the intermediate transfer member 50 can contact each other. A fixing device 25 as the fixing unit is provided near the second transfer device 22. The fixing device 25 includes a fixing belt 26, which is an endless belt, and a pressurizing roller 27 pressed against the fixing belt.

In the tandem image forming apparatus, a sheet overturning device 28 configured to overturn a transfer sheet in order for images to be formed on both sides of the transfer sheet is provided near the second transfer device 22 and the fixing device 25.

Next, formation of a full-color image (color copying) with the tandem developing device 120 will be explained. That is, first, a document is set on a document table 130 of the automatic document feeder (ADF) 400, or the automatic document feeder 400 is opened, the document is set on a contact glass 32 of the scanner 300, and then the automatic document feeder 400 is closed.

Upon a push on a start switch (not shown), the scanner 300 gets started after the document is conveyed to arrive onto the contact glass 32 when the document has been set on the automatic document feeder 400, or immediately after the push on the start switch when the document has been set on the contact glass 32. Then, a first traveling member 33 and a second traveling member 34 move. At this time, the first traveling member 33 irradiates the document surface with light from a light source, and light reflected from the document surface is reflected by a mirror of the second traveling member 34 to be received by a reading sensor 36 through an image forming lens 35, so that the color document (a color image) is read as image information of black, yellow, magenta, and cyan.

Figure 7:
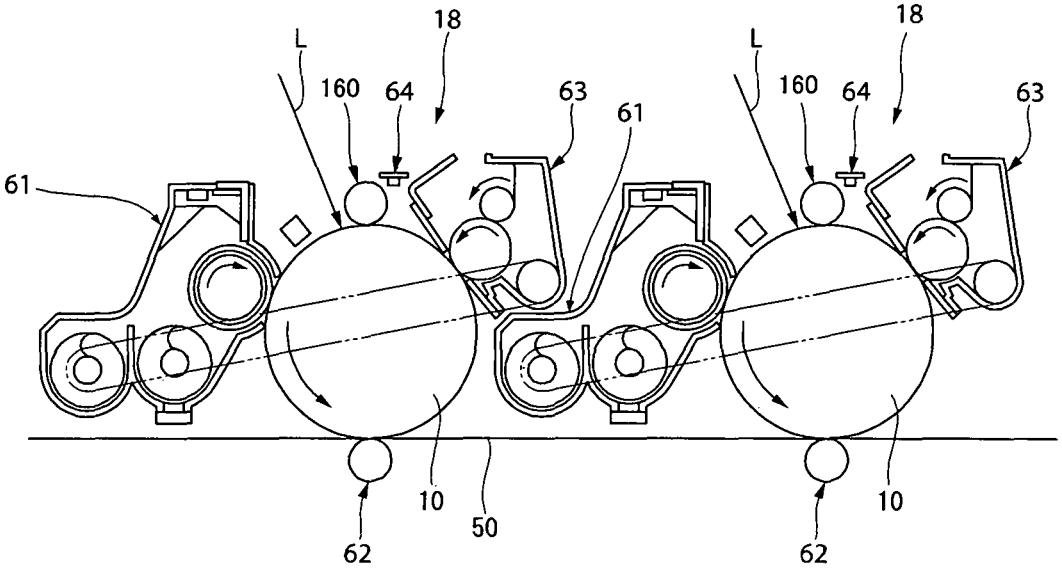
FIG. 7 is an expanded diagram of a portion of FIG. 6.

The respective pieces of image information of black, yellow, magenta, and cyan are transmitted to the respective image forming units 18 (i.e., the black image forming unit, the yellow image forming unit, the magenta image forming unit, and the cyan image forming unit) of the tandem developing device 120. These image forming units form toner images of black, yellow, magenta, and cyan, respectively. That is, the respective image forming units 18 of the tandem developing device 120 (i.e., the black image forming unit, the yellow image forming unit, the magenta image forming unit, and the cyan image forming unit) each include, as shown in FIG. 7, an electrostatic latent image bearing member 10 (i.e., a black electrostatic latent image bearing member 10K, a yellow electrostatic latent image bearing member 10Y, a magenta electrostatic latent image bearing member 10M, or a cyan electrostatic latent image bearing member 10C), a charging device 160 as the charging member configured to electrically charge the electrostatic latent image bearing member 10 uniformly, an exposing device configured to expose the electrostatic latent image bearing member to light (as indicated by a letter L in FIG. 7) imagewise like an image corresponding to the corresponding color image based on the corresponding color image information, to thereby form an electrostatic latent image corresponding to the corresponding color image on the electrostatic latent image bearing member, a developing device 61 as the developing unit configured to develop the electrostatic latent image with a toner of the corresponding color (a black toner, a yellow toner, a magenta toner, or a cyan toner) to thereby form a toner image made of the toner of the corresponding color, a transfer charger 62 configured to transfer the toner image onto the intermediate transfer member 50, a cleaning device 63, and a diselectrifying device 64. The image forming units 18 can each form a single-color image of the corresponding color (a black image, a yellow image, a magenta image, or a cyan image) based on the corresponding color image information. The black image, the yellow image, the magenta image, and the cyan image formed in this way on the black electrostatic latent image bearing member 10K, the yellow electrostatic latent image bearing member 10Y, the magenta electrostatic latent image bearing member 10M, and the cyan electrostatic latent image bearing member 10C respectively are transferred (firstly transferred) onto the intermediate transfer member 50 that is being rotatably moved by the support rollers 14, 15, and 16 sequentially. Then, the black image, the yellow image, the magenta image, and the cyan image are overlaid together on the intermediate transfer member 50 to be formed as a composite color image (a color transfer image).

Meanwhile, in the sheet feeding table 200, one of sheet feeding rollers 142 is selectively rotated to bring sheets (recording sheets) forward from one of sheet feeding cassettes 144 provided multi-stage in a paper bank 143. The sheets are brought forward onto a sheet feeding path 146 separately sheet by sheet via a separating roller 145, conveyed by a conveying roller 147 to be guided onto a sheet feeding path 148 inside the copier body 150, and made to collide on a registration roller 49 and stopped. Alternatively, sheets (recording sheets) on a manual feeding tray 54 are brought forward along with rotation of a sheet feeding roller 142, to be guided onto a manual sheet feeding path 53 separately sheet by sheet via a separating roller 52, and likewise made to collide on the registration roller 49 and stopped. The registration roller 49 is generally used in an earthed state, but may be used in a biased state in order for sheet dusts to be removed. Then, the registration roller 49 is started to rotate so as to be in time for the composite color image (i.e., the color transfer image) composited on the intermediate transfer member 50, to thereby deliver a sheet (a recording sheet) to between the intermediate transfer member 50 and the second transfer device 22, so that the composite color image (the color transfer image) may be transferred (secondly transferred) with the second transfer device 22 onto the sheet (the recording sheet). In this way, the color image is transferred onto the sheet (the recording sheet) and formed thereon. Any residual toner on the intermediate transfer member 50 after having transferred the image is cleaned away by the intermediate transfer member cleaning device 17.

The sheet (the recording sheet) on which the color image has been transferred and formed is conveyed by the second transfer device 22 to be delivered to the fixing device 25, to have the composite color image (the color transfer image) fixed on the sheet (the recording sheet) by the fixing device 25 with heat and pressure. After this, the sheet (the recording sheet) is discharged by a discharging roller 56 as switched thereto by a switching claw 55 and stacked on a sheet discharging tray 57. Alternatively, the sheet is overturned by the sheet overturning device 28 as switched thereto by the switching claw 55, to be guided again to the transfer position, and after having an image recorded also on the back surface thereof, discharged by the discharging roller 56 and stacked on the sheet discharging tray 57.

EXAMPLES

Examples of the present invention will be explained below. However, the present invention is not limited to these Examples in any respects. Values expressed with "parts" mean "parts by mass", unless otherwise expressly specified. Values expressed with "%" mean "% by mass", unless otherwise expressly specified.

<Measurement of Melting Point of Resin and Maximum Melting Point Peak Temperature of Toner>

The melting point of the resin and the maximum melting point peak temperature of the toner were measured with a DSC system (differential scanning calorimeter) ("DSC-60" manufactured by Shimadzu Corporation).

Specifically, among endothermic peak temperatures of a target sample, the maximum endothermic peak temperature was regarded as the melting point when the target sample was a resin, whereas the temperature of a maximum endothermic peak corresponding to the melting point of the resin was obtained according to the following procedure when the target sample was a toner.

With an analyzing program "Endothermic Peak Temperature" included in the DSC-60 system, a DSC curve corresponding to a second temperature elevation was selected from an obtained DSC curve, to obtain the endothermic peak of the target sample in the second temperature elevation.

[Measurement Condition]

Sample container: aluminum-made sample pan (with a cap)

Amount of sample: 5 mg

Reference: aluminum-made sample pan (with 10 mg of alumina)

Atmosphere: nitrogen (at a flow rate of 50 mL/min)

Temperature conditions

Start temperature: 20° C.

Temperature elevating rate: 10° C./min

End temperature: 150° C.

Retention time: none

Temperature lowering rate: 10° C./min

End temperature: −20° C.

Retention time: none

Temperature elevating rate: 10° C./min

End temperature: 150° C.

Manufacture Example 1-1

<Manufacture of Non-Crystalline Segment A1>

A 5 L four-neck flask equipped with a nitrogen introducing pipe, a dehydrating pipe, a stirrer, and a thermocouple was charged with propylene glycol as diol and dimethyl terephthalate and dimethyl adipate as dicarboxylic acids, such that the molar ratio between dimethyl terephthalate and dimethyl adipate (dimethyl terephthalate/dimethyl adipate) would be 90/10 and the ratio between OH group and COOH group (OH/COOH) would be 1.2. The flask was further charged with titanium tetraisopropoxide in an amount of 300 ppm relative to the mass of the materials charged, and the materials were reacted while making methanol flow out. The materials were reacted until the temperature was finally elevated to 230° C. and the acid value of the resin became 5 mgKOH/g or less. After this, the materials were reacted for 4 hours under a reduced pressure of from 20 mmHg to 30 mmHg, to thereby obtain [Non-Crystalline Segment A1], which was a line-shaped non-crystalline polyester resin.

The obtained resin had an acid value (AV) of 1.08 mgKOH/g, a hydroxyl value (OHV) of 23.3 mgKOH/g, and a glass transition temperature (Tg) of 59.2° C.

Manufacture Example 1-2

<Manufacture of Non-Crystalline Segment A2>

A 5 L four-neck flask equipped with a nitrogen introducing pipe, a dehydrating pipe, a stirrer, and a thermocouple was charged with propylene glycol as diol and dimethyl terephthalate and dimethyl fumarate as dicarboxylic acids, such that the molar ratio between dimethyl terephthalate and dimethyl fumarate (dimethyl terephthalate/dimethyl fumarate) would be 83/17 and the ratio between OH group and COOH group (OH/COOH) would be 1.3. The flask was further charged with titanium tetraisopropoxide in an amount of 300 ppm relative to the mass of the materials charged, and the materials were reacted while making methanol flow out. The materials were reacted until the temperature was finally elevated to 230° C. and the acid value of the resin became 5 mgKOH/g or less. After this, the materials were reacted for 4 hours under a reduced pressure of from 20 mmHg to 30 mmHg, to thereby obtain [Non-Crystalline Segment A2], which was a line-shaped non-crystalline polyester resin.

The obtained resin had an acid value (AV) of 0.58 mgKOH/g, a hydroxyl value (OHV) of 24.5 mgKOH/g, and a glass transition temperature (Tg) of 48.7° C.

Manufacture Example 1-3

<Manufacture of Non-Crystalline Segment A3>

A 5 L four-neck flask equipped with a nitrogen introducing pipe, a dehydrating pipe, a stirrer, and a thermocouple was charged with propylene glycol as diol and dimethyl terephthalate as dicarboxylic acid, such that the ratio between OH group and COOH group (OH/COOH) would be 1.2. The flask was further charged with titanium tetraisopropoxide in an amount of 300 ppm relative to the mass of the materials charged, and the materials were reacted while making methanol flow out. The materials were reacted until the temperature was finally elevated to 230° C. and the acid value of the resin became 5 mgKOH/g or less. After this, the materials were reacted for 4 hours under a reduced pressure of from 20 mmHg to 30 mmHg, to thereby obtain [Non-Crystalline Segment A3], which was a line-shaped non-crystalline polyester resin.

The obtained resin had an acid value (AV) of 0.37 mgKOH/g, a hydroxyl value (OHV) of 25.3 mgKOH/g, and a glass transition temperature (Tg) of 72.0° C.

Manufacture Example 1-4

<Manufacture of Non-Crystalline Segment A4>

A 5 L four-neck flask equipped with a nitrogen introducing pipe, a dehydrating pipe, a stirrer, and a thermocouple was charged with propylene glycol as diol and dimethyl terephthalate as dicarboxylic acid, such that the ratio between OH group and COOH group (OH/COOH) would be 2.0. The flask was further charged with titanium tetraisopropoxide in an amount of 300 ppm relative to the mass of the materials charged, and the materials were reacted while making methanol flow out. The materials were reacted until the temperature was finally elevated to 230° C. and the acid value of the resin became 5 mgKOH/g or less. After this, the materials were reacted for 5 minutes under a reduced pressure of from 20 mmHg to 30 mmHg, to thereby obtain [Non-Crystalline Segment A4], which was a line-shaped non-crystalline polyester resin.

The obtained resin had an acid value (AV) of 0.37 mgKOH/g, a hydroxyl value (OHV) of 71.5 mgKOH/g, and a glass transition temperature (Tg) of 59.0° C.

Manufacture Example 2-1

<Manufacture of Crystalline Segment C1 (Crystalline Polyester Resin C1)>

A 5 L four-neck flask equipped with a nitrogen introducing pipe, a dehydrating pipe, a stirrer, and a thermocouple was charged with 1,6-hexanediol as diol and adipic acid as dicarboxylic acid, such that the ratio between OH group and COOH group (OH/COOH) would be 1.1. The flask was further charged with titanium tetraisopropoxide in an amount of 300 ppm relative to the mass of the materials charged, and the materials were reacted while making water flow out. The materials were reacted until the temperature was finally elevated to 230° C. and the acid value of the resin became 5 mgKOH/g or less. After this, the materials were reacted for 5 hours under a reduced pressure of 10 mmHg or less, to thereby obtain [Crystalline Segment C1], which was [Crystalline Polyester Resin C1].

The obtained resin had an acid value (AV) of 0.45 mgKOH/g, a hydroxyl value (Oily) of 29.1 mgKOH/g, and a melting point (Tm) of 56.7° C.

Manufacture Example 2-2

<Manufacture of Crystalline Segment C2 (Crystalline Polyester Resin C2)>

A 5 L four-neck flask equipped with a nitrogen introducing pipe, a dehydrating pipe, a stirrer, and a thermocouple was charged with 1,6-hexanediol as diol and sebacic acid as dicarboxylic acid, such that the ratio between OH group and COOH group (OH/COOH) would be 1.15. The flask was further charged with titanium tetraisopropoxide in an amount of 300 ppm relative to the mass of the materials charged, and the materials were reacted while making water flow out. The materials were reacted until the temperature was finally elevated to 230° C. and the acid value of the resin became 5 mgKOH/g or less. After this, the materials were reacted for 4 hours under a reduced pressure of 10 mmHg or less, to thereby obtain [Crystalline Segment C2], which was [Crystalline Polyester Resin C2].

The obtained resin had an acid value (AV) of 0.52 mgKOH/g, a hydroxyl value (OHV) of 35.8 mgKOH/g, and a melting point (Tm) of 67.2° C.

Manufacture Example 2-3

<Manufacture of Crystalline Segment C3 (Crystalline Polyester Resin C3)>

A 5 L four-neck flask equipped with a nitrogen introducing pipe, a dehydrating pipe, a stirrer, and a thermocouple was charged with 1,4-butanediol as diol and sebacic acid as dicarboxylic acid, such that the ratio between OH group and COOH group (OH/COOH) would be 1.1. The flask was further charged with titanium tetraisopropoxide in an amount of 300 ppm relative to the mass of the materials charged, and the materials were reacted while making water flow out. The materials were reacted until the temperature was finally elevated to 230° C. and the acid value of the resin became 5 mgKOH/g or less. After this, the materials were reacted for 6 hours under a reduced pressure of 10 mmHg or less, to thereby obtain [Crystalline Segment C3], which was [Crystalline Polyester Resin C3].

The obtained resin had an acid value (AV) of 0.38 mgKOH/g, a hydroxyl value (OHV) of 22.6 mgKOH/g, and a melting point (Tm) of 63.8° C.

Manufacture Example 3-1

<Manufacture of Block Copolymer Resin B1>

A 5 L four-neck flask equipped with a nitrogen introducing pipe, a dehydrating pipe, a stirrer, and a thermocouple was charged with [Non-Crystalline Segment A1] (1,300 g) and [Crystalline Segment C1] (700 g), and the materials were dried under a reduced pressure of 10 mmHg at 60° C. for 2 hours. After nitrogen pressure was released, ethyl acetate (2,000 g) having been subjected to dehydrating treatment with a molecular sieve 4A was added thereto, and dissolved therein under a nitrogen stream until the materials became uniform. Then, 4,4'-diphenyl methane diisocyanate (136 g) was added to the system, and stirred under visual observation until the materials became uniform. After this, tin 2-ethylhexanoate as a catalyst was added thereto in an amount of 100 ppm relative to the mass of the solid content of the resin, and the materials were reacted under a reflux for 5 hours while the temperature was elevated to 80° C. Then, under a reduced pressure, ethyl acetate was distilled away, to thereby obtain [Block Copolymer Resin B1]. The characteristic values of the obtained resin are shown in Table 1.

Manufacture Example 3-2

<Manufacture of Block Copolymer Resin B2>

A 5 L four-neck flask equipped with a nitrogen introducing pipe, a dehydrating pipe, a stirrer, and a thermocouple was charged with [Non-Crystalline Segment A1] (1,480 g) and [Crystalline Segment C1] (520 g), and the materials were dried under a reduced pressure of 10 mmHg at 60° C. for 2 hours. After nitrogen pressure was released, ethyl acetate (2,000 g) having been subjected to dehydrating treatment with a molecular sieve 4A was added thereto, and dissolved therein under, a nitrogen stream until the materials became uniform. Then, 4,4'-diphenyl methane diisocyanate (133 g) was added to the system, and stirred under visual observation until the materials became uniform. After this, tin 2-ethylhexanoate as a catalyst was added thereto in an amount of 100 ppm relative to the mass of the solid content of the resin, and the materials were reacted under a reflux for 5 hours while the temperature was elevated to 80° C. Then, under a reduced pressure, ethyl acetate was distilled away, to thereby obtain [Block Copolymer Resin B2]. The characteristic values of the obtained resin are shown in Table 1.

Manufacture Example 3-3

<Manufacture of Block Copolymer Resin B3>

A 5 L four-neck flask equipped with a nitrogen introducing pipe, a dehydrating pipe, a stirrer, and a thermocouple was charged with [Non-Crystalline Segment A2] (1,550 g) and [Crystalline Segment C2] (450 g), and the materials were dried under a reduced pressure of 10 mmHg at 60° C. for 2 hours. After nitrogen pressure was released, ethyl acetate (2,000 g) having been subjected to dehydrating treatment with a molecular sieve 4A was added thereto, and dissolved therein under a nitrogen stream until the materials became uniform. Then, 4,4'-diphenyl methane diisocyanate (145 g) was added to the system, and stirred under visual observation until the materials became uniform. After this, tin 2-ethylhexanoate as a catalyst was added thereto in an amount of 100 ppm relative to the mass of the solid content of the resin, and the materials were reacted under a reflux for 5 hours while the temperature was elevated to 80° C. Then, under a reduced pressure, ethyl acetate was distilled away, to thereby obtain [Block Copolymer Resin B3]. The characteristic values of the obtained resin are shown in Table 1.

Manufacture Example 3-4

<Manufacture of Block Copolymer Resin B4>

A 5 L four-neck flask equipped with a nitrogen introducing pipe, a dehydrating pipe, a stirrer, and a thermocouple was charged with [Non-Crystalline Segment A1] (1,560 g) and [Crystalline Segment C2] (440 g), and the materials were dried under a reduced pressure of 10 mmHg at 60° C. for 2 hours. After nitrogen pressure was released, ethyl acetate (2,000 g) having been subjected to dehydrating treatment with a molecular sieve 4A was added thereto, and dissolved therein under a nitrogen stream until the materials became uniform. Then, 4,4'-diphenyl methane diisocyanate (140 g) was added to the system, and stirred under visual observation until the materials became uniform. After this, tin 2-ethylhexanoate as a catalyst was added thereto in an amount of 100 ppm relative to the mass of the solid content of the resin, and the materials were reacted under a reflux for 5 hours while the temperature was elevated to 80° C. Then, under a reduced pressure, ethyl acetate was distilled away, to thereby obtain [Block Copolymer Resin B4]. The characteristic values of the obtained resin are shown in Table 1.

Manufacture Example 3-5

<Manufacture of Block Copolymer Resin B5>

A 5 L four-neck flask equipped with a nitrogen introducing pipe, a dehydrating pipe, a stirrer, and a thermocouple was charged with [Non-Crystalline Segment A1] (1,650 g) and [Crystalline Segment C2] (350 g), and the materials were dried under a reduced pressure of 10 mmHg at 60° C. for 2 hours. After nitrogen pressure was released, ethyl acetate (2,000 g) having been subjected to dehydrating treatment with a molecular sieve 4A was added thereto, and dissolved therein under a nitrogen stream until the materials became uniform. Then, 4,4'-diphenyl methane diisocyanate (137 g) was added to the system, and stirred under visual observation until the materials became uniform. After this, tin 2-ethylhexanoate as a catalyst was added thereto in an amount of 100 ppm relative to the mass of the solid content of the resin, and the materials were reacted under a reflux for 5 hours while the temperature was elevated to 80° C. Then, under a reduced pressure, ethyl acetate was distilled away, to thereby obtain [Block Copolymer Resin B5]. The characteristic values of the obtained resin are shown in Table 1.

(Manufacture Example 3-6

<Manufacture of Block Copolymer Resin B6>

A 5 L four-neck flask equipped with a nitrogen introducing pipe, a dehydrating pipe, a stirrer, and a thermocouple was charged with [Non-Crystalline Segment A3] (1,450 g) and [Crystalline Segment C3] (550 g), and the materials were dried under a reduced pressure of 10 mmHg at 60° C. for 2 hours. After nitrogen pressure was released, ethyl acetate (2,000 g) having been subjected to dehydrating treatment with a molecular sieve 4A was added thereto, and dissolved therein under a nitrogen stream until the materials became uniform. Then, 4,4'-diphenyl methane diisocyanate (132 g) was added to the system, and stirred under visual observation until the materials became uniform. After this, tin 2-ethylhexanoate as a catalyst was added thereto in an amount of 100 ppm relative to the mass of the solid content of the resin, and the materials were reacted under a reflux for 5 hours while the temperature was elevated to 80° C. Then, under a reduced pressure, ethyl acetate was distilled away, to thereby obtain [Block Copolymer Resin B6]. The characteristic values of the obtained resin are shown in Table 1.

Manufacture Example 3-7

<Manufacture of Block Copolymer Resin B7>

A 5 L four-neck flask equipped with a nitrogen introducing pipe, a dehydrating pipe, a stirrer, and a thermocouple was charged with [Crystalline Segment C3] (520 g), and the material was dried under a reduced pressure of 10 mmHg at 60° C. for 2 hours. After nitrogen pressure was released, while the temperature was elevated to 80° C. under nitrogen stream, 4,4'-diphenyl methane diisocyanate (136 g) was added to the system, and the materials were reacted for 1 hour. Then, a solution containing [Non-Crystalline Segment A1] (1,480 g) prepared in advance and ethyl acetate (2,000 g) having been subjected to dehydrating treatment with a molecular sieve 4A was added, and the materials were stirred under a nitrogen stream until they became uniform. After this, tin 2-ethylhexanoate as a catalyst was added thereto in an amount of 100 ppm relative to the mass of the solid content of the resin, and the materials were reacted under a reflux for 5 hours while the temperature was elevated to 80° C. Then, under a reduced pressure, ethyl acetate was distilled away, to thereby obtain [Block Copolymer Resin B7]. The characteristic values of the obtained resin are shown in Table 1.

Manufacture Example 3-8

<Manufacture of Block Copolymer Resin B8>

A 5 L four-neck flask equipped with a nitrogen introducing pipe, a dehydrating pipe, a stirrer, and a thermocouple was charged with [Non-Crystalline Segment A1] (900 g) and [Crystalline Segment C1] (1,100 g), and the materials were dried under a reduced pressure of 10 mmHg at 60° C. for 2 hours. After nitrogen pressure was released, ethyl acetate (2,000 g) having been subjected to dehydrating treatment with a molecular sieve 4A was added thereto, and dissolved therein under a nitrogen stream until the materials became uniform. Then, 4,4'-diphenyl methane diisocyanate (142 g) was added to the system, and stirred under visual observation until the materials became uniform. After this, tin 2-ethylhexanoate as a catalyst was added thereto in an amount of 100 ppm relative to the mass of the solid content of the resin, and the materials were reacted under a reflux for 5 hours while the temperature was elevated to 80° C. Then, under a reduced pressure, ethyl acetate was distilled away, to thereby obtain [Block Copolymer Resin B8]. The characteristic values of the obtained resin are shown in Table 1.

Manufacture Example 3-9

<Manufacture of Block Copolymer Resin B9>

A 5 L four-neck flask equipped with a nitrogen introducing pipe, a dehydrating pipe, a stirrer, and a thermocouple was charged with [Non-Crystalline Segment A4] (825 g) and [Crystalline Segment C3] (1,175 g), and the materials were dried under a reduced pressure of 10 mmHg at 60° C. for 2 hours. After nitrogen pressure was released, ethyl acetate (2,000 g) having been subjected to dehydrating treatment with a molecular sieve 4A was added thereto, and dissolved therein under a nitrogen stream until the materials became uniform. Then, 4,4'-diphenyl methane diisocyanate (121 g) was added to the system, and stirred under visual observation until the materials became uniform. After this, tin 2-ethylhexanoate as a catalyst was added thereto in an amount of 100 ppm relative to the mass of the solid content of the resin, and the materials were reacted under a reflux for 5 hours while the temperature was elevated to 80° C. Then, under a reduced pressure, ethyl acetate was distilled away, to thereby obtain [Block Copolymer Resin B9]. The characteristic values of the obtained resin are shown in Table 1.

Manufacture Example 3-10

<Manufacture of Block Copolymer Resin B10>

A 5 L four-neck flask equipped with a nitrogen introducing pipe, a dehydrating pipe, a stirrer, and a thermocouple was charged with [Non-Crystalline Segment A3] (1,870 g) and [Crystalline Segment C1] (130 g), and the materials were dried under a reduced pressure of 10 mmHg at 60° C. for 2 hours. After nitrogen pressure was released, ethyl acetate (2,000 g) having been subjected to dehydrating treatment with a molecular sieve 4A was added thereto, and dissolved therein under a nitrogen stream until the materials became uniform. Then, 4,4'-diphenyl methane diisocyanate (68 g) was added to the system, and stirred under visual observation until the materials became uniform. After this, tin 2-ethylhexanoate as a catalyst was added thereto in an amount of 100 ppm relative to the mass of the solid content of the resin, and the materials were reacted under a reflux for 5 hours while the temperature was elevated to 80° C. Then, under a reduced pressure, ethyl acetate was distilled away, to thereby obtain [Block Copolymer Resin B10]. The characteristic values of the obtained resin are shown in Table 1.

Manufacture Example 4

<Manufacture of Colorant Master Batch>

[Block Copolymer Resin B1] (100 parts), a cyan pigment (C.I. Pigment blue 15:3) (100 parts), and ion-exchanged water (30 parts) were mixed well, and kneaded with an open-roll kneader (KNEADEX manufactured by Nippon Coke & Engineering Co., Ltd.). The kneading was started at a temperature of 90° C., and after this, the temperature was lowered gradually to 50° C., to thereby manufacture [Colorant Master Batch P1] in which the ratio (on the mass basis) between the resin and the pigment was 1:1.

Further, [Colorant Master Batch P2] to [Colorant Master Batch P10] were manufactured in the same manner, except that [Block Copolymer Resin B1] was changed to [Block Copolymer Resin B2] to [Block Copolymer Resin B10], respectively.

Manufacture Example 5

<Manufacture of Wax Dispersed Liquid>

A reaction vessel equipped with a cooling pipe, a thermometer, and a stirrer was charged with paraffin wax (HNP-9 (with a melting point of 75° C.), manufactured by Nippon Seiro Co., Ltd.) (20 parts) and ethyl acetate (80 parts). The materials were dissolved well while being heated to 78° C., and cooled to 30° C. in 1 hour while being stirred. After this, the materials were subjected to wet pulverization with an ultra visco mill (manufactured by Aimex Co., Ltd.) at a liquid sending speed of 1.0 kg/hour, at a disk circumferential velocity of 10 m/second, with zirconia beads with a diameter of 0.5 mm packed to 80% by volume, and for 6 passes. Then, ethyl acetate was added thereto to adjust the solid content concentration, to thereby obtain [Wax Dispersed Liquid] with a solid content concentration of 20%.

TABLE 1

| | Block copolymer resin | Non-crystalline segment | Crystalline segment | Crystalline segment/Non-crystalline segment (molar ratio) | Melting point Tm (° C.) | Dispersion diameter of phase image |
|---|---|---|---|---|---|---|
| Manufacture Example 3-1 | B1 | A1 | C1 | 40/60 | 56.5 | 148 |
| Manufacture Example 3-2 | B2 | A1 | C1 | 30/70 | 56.3 | 95 |
| Manufacture Example 3-3 | B3 | A2 | C2 | 30/70 | 65.4 | 80 |
| Manufacture Example 3-4 | B4 | A1 | C2 | 30/70 | 67.1 | 54 |
| Manufacture Example 3-5 | B5 | A1 | C2 | 25/75 | 67.1 | 50 |
| Manufacture Example 3-6 | B6 | A3 | C3 | 25/75 | 63.4 | 25 |
| Manufacture Example 3-7 | B7 | A1 | C3 | 30/70 | 59.8 | 25 |
| Manufacture Example 3-8 | B8 | A1 | C1 | 60/40 | 56.5 | 158 |
| Manufacture Example 3-9 | B9 | A4 | C3 | 30/70 | 62.1 | 20 |
| Manufacture Example 3-10 | B10 | A3 | C1 | 7.5/92.5 | 55.8 | 43 |

Example 1

<Manufacture of Toner 1>

A vessel equipped with a thermometer and a stirrer was charged with [Block Copolymer Resin B1] (94 parts) and ethyl acetate (81 parts), and the materials were dissolved well while being heated to equal to or higher than the melting point of the resin. Then, [Wax Dispersed Liquid] (25 parts) and [Colorant Master Batch P1] (12 parts) were added thereto, and the resultant was stirred with a TK homomixer (manufactured by Primix Corporation) at 50° C. at a rotation speed of 10,000 rpm so that the materials were dissolved and dispersed uniformly, to thereby obtain [Oil Phase 1]. The temperature of [Oil Phase 1] was maintained at 50° C. in the vessel.

Next, in another vessel equipped with a stirrer and a thermometer, ion-exchanged water (75 parts), a 25% dispersion liquid of organic resin fine particles for dispersion stabilization (a copolymer of styrene-methacrylic acid-butyl acrylate-sodium salt of sulfuric acid ester of methacrylic acid ethylene oxide adduct) (manufactured by Sanyo Chemical Industries, Ltd.) (3 parts), carboxymethyl cellulose sodium (CELLOGEN BS-H-3 manufactured by Dai-ichi Kogyo Seiyaku Co., Ltd.) (1 part), a 48.5% aqueous solution of dodecyl diphenyl ether disulfonic acid sodium (ELEMINOL MON-7, manufactured by Sanyo Chemical Industries, Ltd.) (16 parts), and ethyl acetate (5 parts) were mixed and stirred at 40° C., to thereby manufacture an aqueous phase solution ([Aqueous Phase 1]). [Oil Phase 1] (50 parts) maintained at 50° C. was added to the whole of the manufactured [Aqueous Phase 1], and they were mixed at 45° C. to 48° C. with a TK homomixer (manufactured by Primix Corporation) at a rotation speed of 12,000 rpm for 1 minute, to thereby obtain [Emulsified Slurry 1].

[Emulsified Slurry 1] was put in a vessel equipped with a stirrer and a thermometer, and desolventized at 50° C. for 2 hours, to thereby obtain [Slurry 1].

The obtained [Slurry] of toner base particles (100 parts) was filtered at a reduced pressure to obtain a filter cake. The filter cake was washed in the following manner.

(1) Ion-exchanged water (100 parts) was added to the filter cake, and they were mixed with a TK homomixer (at a rotation speed of 6,000 rpm for 5 minutes), and after this, filtered.
(2) A 10% sodium hydroxide aqueous solution (100 parts) was added to the filter cake of (1), and they were mixed with a TK homomixer (at a rotation speed of 6,000 rpm for 10 minutes), and after this, filtered.
(3) 10% hydrochloric acid (100 parts) was added to the filter case of (2), and they were mixed with a TK homomixer (at a rotation speed of 6,000 rpm for 5 minutes), and after this, filtered.
(4) Ion-exchanged water (300 parts) was added to the filter case of (3), and they were mixed with a TK homomixer (at a rotation speed of 6,000 rpm for 5 minutes), and after this, filtered twice, to thereby obtain [Filter Cake 1].

The obtained [Filter Cake 1] was dried with a circulating air dryer at 45° C. for 48 hours, and after this, sieved through a mesh with a mesh size of 75 μm, to thereby manufacture [Toner Base Particles 1] Next, hydrophobic silica (HDK-2000 manufactured by Wacker Chemie) (1.0 part) and titanium oxide (MT-150 AI manufactured by Tayca Corporation) (0.3 parts) were mixed with the obtained [Toner Base Particles 1] (100 parts) with a Henschel mixer, to thereby obtain [Toner 1]. Particle size distribution, maximum melting point peak temperature, pulse NMR relaxation time, and dispersion diameter of a phase image were measured from the obtained toner. The results are shown in Table 3.

<Manufacture of Carrier 1>

As a core material, Mn ferrite particles (with a weight average diameter of 35 μm) (5,000 parts) were used.

As a coating material, a coating liquid prepared by dispersing with a stirrer for 10 minutes, toluene (300 parts), butyl cellosolve (300 parts), an acrylic resin solution (with a composition ratio (on the molar basis) of methacrylic acid:methyl methacrylate:2-hydroxyethyl acrylate=5:9:3, a toluene solution with a 50% solid content and Tg of 38° C.) (60 parts), an N-tetramethoxymethyl benzoguanamine resin solution (with a degree of polymerization of 1.5, a toluene solution with a 77% solid content) (15 parts), and alumina particles (with an average primary particle size of 0.30 μm) (15 parts) was used.

The core material and the coating liquid were put into a coating apparatus including a rotary bottom plate disk and a stirring blade in a fluid bed and configured to perform coating by forming a swirling flow, to thereby coat the core material with the coating liquid. The obtained coated product was burned in an electric furnace at 220° C. for 2 hours, to thereby obtain [Carrier 1].

<Manufacture of Developer 1>

[Carrier 1] (100 parts) and [Toner 1] (7 parts) were mixed with each other uniformly with TURBULA MIXER (manufactured by Willy A. Bachofen (WAB)) configured to perform stirring with a rolling motion of a container at a rotation speed of 48 rpm for 5 minutes, to thereby obtain [Developer 1], which was a two-component developer.

The developing unit of an indirect transfer type tandem image forming apparatus shown in FIG. 6, which employed a contact type charging system, a two-component developing system, a twice-transfer system, a blade cleaning system, and a roller fixing system based on external heating was charged with the obtained two-component developer, and images were formed with this apparatus, to perform the following performance evaluation. The results are shown in Table 4.

<Evaluation>

<<Fixability (Minimum Fixing Temperature)>>

With the image forming apparatus shown in FIG. 6, a whole-surface solid image (with an image size of 3 cm×8 cm) with an amount of toner to be deposited after transferred of 0.85±0.10 mg/cm$^2$ was formed on transfer sheets (photocopy sheets <70> manufactured by Ricoh Business Expert Co., Ltd.) and fixed thereon, with the fixing belt set to various temperatures. With a drawing tester AD-401 (manufactured by Ueshima Seisakusho Co., Ltd.), a picture was drawn on the surface of the obtained fixed image with a ruby needle (having a tip radius of 260 μmR to 320 μmR and a tip angle of 60°) under a load of 50 g. The picture-drawn surface was strongly scraped 5 times with fabric (HANIKOTTO #440 manufactured by Haneron Corporation Ltd.), and the temperature of the fixing belt at which almost no scraping scraps of the image occurred was determined as the minimum fixing temperature. The solid image was formed on the transfer sheet at a position of 3.0 cm from an end of the sheet from which the sheet was passed through the apparatus. The speed at which the sheet was passed through the nip portion of the fixing device was 280 mm/s. The lower the minimum fixing temperature, the better the low temperature fixability.

[Evaluation Criteria]

AA: 105° C. or lower
A: higher than 105° C. but equal to or lower than 110° C.
B: higher than 110° C. but equal to or lower than 115° C.
C: higher than 115° C. but equal to or lower than 130° C.
D: higher than 130° C.

<<Heat Resistant Storage Stability (Penetration Degree)>>

Each toner was put in a 50 mL glass container, and left in a thermostatic chamber at 50° C. for 24 hours. The resulting toner was cooled to 24° C., and the penetration degree (mm) thereof was measured according to a penetration test (JISK2235-1991) and evaluated based on the following criteria. The larger the value of the penetration degree, the better the heat resistant storage stability. When the penetration degree is less than 5 mm, a trouble will highly probably occur in use.

In the present invention, the penetration degree was expressed as penetration depth (mm).

[Evaluation Criteria]

AA: Penetration degree is 25 mm or more

A: Penetration degree is 20 mm or more but less than 25 mm

B: Penetration degree is 10 mm or more but less than 20 mm

C: Penetration degree is 5 mm or more but less than 10 mm

D: Penetration degree is less than 5 mm

<<Sheet Discharging Friction Resistance Follow-up Evaluation>>

Presence or absence of any less-glossy portions or any glossier portions, and presence or absence of any image scars or image peeling in the fixed image due to contacts with the conveying member were visually observed, and evaluated based on the following criteria.

[Evaluation Criteria]

AA: No mark of contact with any members after fixation was observed.

A: Slight glossiness difference was found between portions contacted with any members and nearby non-contacted portions, and depending on how to irradiate with light, a mark of contact was barely perceived by visual observation.

B: Slight glossiness difference was found between portions contacted with any members and nearby non-contacted portions, and depending on how to irradiate with light, a mark of contact was perceived by visual observation.

C: Apparent glossiness difference was found between portions contacted with any members and nearby non-contacted portions, and a mark of contact was perceived by visual observation. Or, a streaky scar was found.

D: Apparent glossiness difference was found between portions contacted with any members and nearby non-contacted portions, and a mark of contact was perceived by visual observation. Or, a deep streaky scar was found, and the toner was peeled from some portions to show the sheet surface.

<<Image Adhesion (Stacking Property)>>

With the image forming apparatus shown in FIG. 6, unfixed whole-surface solid images (the amount of toner deposited being 0.85 mg/cm$^2$) formed on thirty A4 sheets were passed through the fixing device serially. Then, the sheets were immediately stacked together, and further loaded with seventy A4 sheets. The image state after the sheets were left for 10 minutes was evaluated based on the following criteria.

[Evaluation Criteria]

A: The sheets did not adhere to each other, and could be easily separated.

B: The sheets did not adhere to each other, but some of them were less easy to separate.

C: The sheets did adhere to each other, but no mark of separation was left on the image.

D: The sheets heavily adhered to each other, and the toner on the image peeled when the sheets were forcibly separated.

DD: The sheets heavily adhered to each other, and the toner on the image peeled and the sheet tore when the sheets were forcibly separated.

<<White Void Image Evaluation>>

With IMAGIO C2802 (manufactured by Ricoh Company Ltd.), which was loaded with a developer manufactured with the obtained toner, ten thousand A4 sheets were printed serially with an image occupation rate of 5%. After the test, a full-surface solid image (with the amount of toner deposited being 0.4 mg/cm$^2$) was output on three A4 sheets, and the number of images with density unevenness in the sheets and the number of images with any white void in the sheets were counted by visual observation, and evaluated based on the following evaluation criteria.

[Evaluation Criteria]

AA: Images with density unevenness and images with white voids were found from none of the three sheets.

A: Images with white voids were found from none of the three sheets, but a total of 1 to 3 images with slight density unevenness were found from the three sheets.

B: Images with white voids were found from none of the three sheets, but a total of 4 to 8 images with slight density unevenness were found from the three sheets.

C: A total of 1 to 3 images with white voids were found from the three sheets.

D: A total of 4 or more images with white voids were from the three sheets.

Examples 2 to 6

<Manufacture of Toners 2 to 6 and Developer 2 to 6>

[Toner 2] to [Toner 6] and [Developer 2] to [Developer 6] were manufactured in the same manner as Example 1, except that [Block Copolymer Resin B1] used in Manufacture of the toner of Example 1 was changed to [Block Copolymer resin B2] to [Block Copolymer resin B6] respectively as shown in Table below, and [Colorant Master Batch P1] was changed to [Colorant Master Batch P2] to [Colorant Master Batch P6] respectively as shown in Table 2 below. Then, the qualities of the toners and the developers were evaluated. The results are shown in Table 3 and Table 4.

TABLE 2

| | Toner | Colorant Master Batch |
|---|---|---|
| Example 2 | Toner 2 | P2 |
| Example 3 | Toner 3 | P3 |
| Example 4 | Toner 4 | P4 |
| Example 5 | Toner 5 | P5 |
| Example 6 | Toner 6 | P6 |

Example 7

<Manufacture of Toner 7>

[Toner 7] and [Developer 7] were manufactured in the same manner as Example 1, except that [Block Copolymer Resin B1] (94 parts) used for manufacturing [Oil Phase 1] in the manufacture of Toner of Example 1 was changed to [Block Copolymer Resin B6] (94 parts) and [Crystalline Segment C2] (4.7 parts), and [Colorant Master Batch P1] was changed to [Colorant Master Batch P6]. The qualities of the toner and the developer were evaluated. The results are shown in Table 3 and Table 4.

<Manufacture of Toner 8>

[Toner 8] and [Developer 8] were manufactured in the same manner as Example 1, except that [Block Copolymer Resin B1] (94 parts) used for manufacturing [Oil Phase 1] in the manufacture of Toner of Example 1 was changed to [Block Copolymer Resin B6] (94 parts) and [Crystalline Segment C2] (14.1 parts), and [Colorant Master Batch P1] was changed to [Colorant Master Batch P6]. The qualities of the toner and the developer were evaluated. The results are shown in Table 3 and Table 4.

Example 9

<Manufacture of Toner 9>

[Toner 9] and [Developer 9] were manufactured in the same manner as Example 1, except that [Block Copolymer Resin B1] (94 parts) used for manufacturing [Oil Phase 1] was changed to [Block Copolymer Resin B7] (94 parts) and [Crystalline Segment C2] (4.7 parts), and [Colorant Master Batch P1] was changed to [Colorant Master Batch P7]. The qualities of the toner and the developer were evaluated. The results are shown in Table 3 and Table 4.

Comparative Example 1

<Manufacture of Toner 10>

[Toner 10] and [Developer 10] were manufactured in the same manner as Example 1, except that [Block Copolymer Resin B1] used in the manufacture of the toner of Example 1 was changed to [Block Copolymer Resin B8] and [Colorant Master Batch P1] was changed to [Colorant Master Batch P8]. The qualities of the toner and the developer were evaluated. The results are shown in Table 3 and Table 4.

Comparative Example 2

<Manufacture of Toner 11>

[Toner 11] and [Developer 11] were manufactured in the same manner as Example 1, except that [Block Copolymer Resin B1] used in the manufacture of the toner of Example 1 was changed to [Block Copolymer Resin B9] and [Colorant Master Batch P1] was changed to [Colorant Master Batch P9]. The qualities of the toner and the developer were evaluated. The results are shown in Table 3 and Table 4.

Comparative Example 3

<Manufacture of Toner 12>

[Toner 12] and [Developer 12] were manufactured in the same manner as Example 1, except that [Block Copolymer Resin B1] used in the manufacture of the toner of Example 1 was changed to [Block Copolymer Resin B10] and [Colorant Master Batch P1] was changed to [Colorant Master Batch P10]. The qualities of the toner and the developer were evaluated. The results are shown in Table 3 and Table 4.

Comparative Example 4

<Manufacture of Toner 13>

[Toner 13] and [Developer 13] were manufactured in the same manner as Example 7, except that the ratio of use between [Block Copolymer Resin B6] and [Crystalline Segment C2] in the binder resin used in the manufacture of the toner of Example 7 was changed to the ratio of use shown in Table 3. The qualities of the toner and the developer were evaluated. The results are shown in Table 3 and Table 4.

TABLE 3

| | | Resins in binder resin and ratio of use | | | | | | Max. | | | | |
|---|---|---|---|---|---|---|---|---|---|---|---|---|
| | | Block | Ratio of | Crystalline | Ratio of | | | melting | Pulse NMR relaxation time | | | Dispersion |
| | | copolymer | use (% by | polyester | use (% by | Particle size distribution | | peak | t50 | t130 | t'70 | diameter of phase |
| | Toner | resin | mass) | resin | mass) | Dv (μm) | Dv/Dn | temp. (° C.) | (ms) | (ms) | (ms) | image (nm) |
| Ex. 1 | Toner 1 | B1 | 100 | — | — | 5.3 | 1.15 | 56.3 | 0.05 | 19 | 0.98 | 150 |
| Ex. 2 | Toner 2 | B2 | 100 | — | — | 5.2 | 1.15 | 56.0 | 0.04 | 15 | 0.75 | 98 |
| Ex. 3 | Toner 3 | B3 | 100 | — | — | 5.3 | 1.14 | 65.0 | 0.04 | 20 | 0.53 | 83 |
| Ex. 4 | Toner 4 | B4 | 100 | — | — | 5.2 | 1.15 | 66.4 | 0.03 | 21 | 0.51 | 55 |
| Ex. 5 | Toner 5 | B5 | 100 | — | — | 5.3 | 1.14 | 66.2 | 0.03 | 20 | 0.51 | 50 |
| Ex 6 | Toner 6 | B6 | 100 | — | — | 5.4 | 1.15 | 63.1 | 0.02 | 26 | 0.65 | 28 |
| Ex. 7 | Toner 7 | B6 | 95 | C2 | 5 | 5.4 | 1.13 | 63.8 | 0.02 | 29 | 0.61 | 36 |
| Ex. 8 | Toner 8 | B6 | 85 | C2 | 15 | 5.2 | 1.14 | 63.8 | 0.05 | 32 | 0.68 | 62 |
| Ex. 9 | Toner 9 | B7 | 95 | C2 | 5 | 5.4 | 1.14 | 60.5 | 0.03 | 24 | 0.80 | 31 |
| Comp. Ex. 1 | Toner 10 | B8 | 100 | — | — | 5.2 | 1.14 | 56.5 | 2.10 | 10 | 4.10 | 165 |
| Comp. Ex. 2 | Toner 11 | B9 | 100 | — | — | 5.3 | 1.14 | 62.2 | 0.08 | 34 | 0.98 | 20 |
| Comp. Ex. 3 | Toner 12 | B10 | 100 | — | — | 4.9 | 1.17 | 56.2 | 0.03 | 12 | 0.35 | 49 |
| Comp. Ex. 4 | Toner 13 | B6 | 80 | C2 | 20 | 5.5 | 1.17 | 64.0 | 0.05 | 35 | 1.18 | 81 |

TABLE 4

| | Evaluated toner/ developer | | Results of quality evaluation | | | | |
|---|---|---|---|---|---|---|---|
| | | | White void | Sheet discharging friction resistance | Stack storage stability | Low temperature fixability | Heat resistant storage stability |
| Ex. 1 | Toner 1 | Developer 1 | C | B | C | B | B |
| Ex. 2 | Toner 2 | Developer 2 | B | B | C | B | B |
| Ex. 3 | Toner 3 | Developer 3 | B | A | C | A | B |
| Ex. 4 | Toner 4 | Developer 4 | A | A | B | A | B |
| Ex. 5 | Toner 5 | Developer 5 | A | A | B | A | B |
| Ex 6 | Toner 6 | Developer 6 | AA | AA | A | A | B |
| Ex. 7 | Toner 7 | Developer 7 | AA | A | A | AA | A |
| Ex. 8 | Toner 8 | Developer 8 | B | B | C | AA | AA |
| Ex. 9 | Toner 9 | Developer 9 | AA | A | A | A | B |
| Comp. Ex. 1 | Toner 10 | Developer 10 | D | D | DD | D | C |
| Comp. Ex. 2 | Toner 11 | Developer 11 | D | B | C | B | B |
| Comp. Ex. 3 | Toner 12 | Developer 12 | B | A | B | D | B |
| Comp. Ex. 4 | Toner 13 | Developer 13 | C | D | D | AA | C |

Aspects of the present invention are as follows, for example.

<1> A toner, including a binder resin, wherein the binder resin includes a copolymer resin that includes a structural unit derived from a crystalline resin and a structural unit derived from a non-crystalline resin, wherein a spin-spin relaxation time (t50) of the toner at 50° C. measured by pulse NMR is 0.05 msec. or shorter, a spin-spin relaxation time (t130) of the toner at 130° C. when warmed from 50° C. to 130° C. is 15 msec. or longer, and a spin-spin relaxation time (t'70) of the toner at 70° C. when cooled from 130° C. to 70° C. is 1.00 msec. or shorter, and wherein a binarized image of the toner, which is obtained by binarizing a phase image of the toner observed by a tapping mode AFM based on an intermediate value between a maximum value and a minimum value of phase difference in the phase image, includes first phase difference images constituted by portions having a large phase difference and a second phase difference image constituted by a portion having a small phase difference, the first phase difference images are dispersed in the second phase difference image, and a dispersion diameter of the first phase difference images is 150 nm or less.

<2> The toner according to <1>, wherein the copolymer resin is a copolymer resin that includes a structural unit derived from a crystalline polyester resin and a structural unit derived from a non-crystalline polyester resin.

<3> The toner according to <2>, wherein the crystalline polyester resin in the structural unit derived from the crystalline polyester resin contains a dihydric aliphatic alcohol component and a divalent aliphatic carboxylic acid component as constituent components, and wherein the non-crystalline polyester resin in the structural unit derived from the non-crystalline polyester resin contains a dihydric aliphatic alcohol component and a polyvalent aromatic carboxylic acid component as constituent components.

<4> The toner according to any one of <1> to <3>, wherein the crystalline resin and the non-crystalline resin in the copolymer resin have a molar ratio (crystalline resin/non-crystalline resin) of from 10/90 to 40/60.

<5> The toner according to any one of <1> to <4>, wherein the first phase difference images have a dispersion diameter of from 10 nm to 100 nm.

<6> The toner according to any one of <1> to <5>, wherein the copolymer resin is produced by reacting the crystalline resin, the non-crystalline resin, and an elongating agent that contains two or more of any of isocyanate group, epoxy group, and carbodiimide group.

<7> The toner according to any one of <1> to <6>, wherein the binder resin further contains a crystalline resin.

<8> A developer, including the toner according to any one of <1> to <7>.

<9> An image forming apparatus, including:

an electrostatic latent image bearing member;

an electrostatic latent image forming unit configured to form an electrostatic latent image on the electrostatic latent image bearing member; and a developing unit including a toner and configured to develop the electrostatic latent image formed on the electrostatic latent image bearing member to form a visible image, wherein the toner is the toner according to any one of <1> to <7>.

<10> An image forming method, including:

a developing step of developing an electrostatic latent image formed on an electrostatic latent image bearing member with a toner to form a visible image;

a transfer step of transferring the visible image to a recording medium; and a fixing step of fixing the visible image transferred to the recording medium thereon, wherein the toner is the toner according to any one of <1> to <7>.

REFERENCE SIGNS LIST

10 electrostatic latent image bearing member

61 developing device

100 image forming apparatus

The invention claimed is:

1. A toner, comprising:

a binder resin, comprising a copolymer resin comprising a structural unit derived from a crystalline polyester resin and a structural unit derived from a non-crystalline polyester resin, such that a molar ratio of a crystalline segment to a non-crystalline segment in the copolymer resin is from 10/90 to 40/60, where the crystalline segment comprises the structural unit derived from the crystalline polyester resin and the non-crystalline segment comprises the structural unit derived from the non-crystalline polyester resin, wherein a spin-spin relaxation time (t50) of the toner at 50° C. measured by pulse NMR is 0.05 msec or shorter, a spin-spin relaxation time (t130) of the toner at 130° C. when warmed from 50° C. to 130° C. is 15 msec or longer, and a spin-spin relaxation time (t'70) of the toner at 70° C. when cooled from 130° C. to 70° C. is 1.00 msec or shorter, and a binarized image of the toner, which is obtained by binarizing a phase image of the toner observed by a tapping mode AFM based on an intermediate value between a maximum value and a minimum value of phase difference in the phase image, includes first phase difference images constituted by portions having a large phase difference, and a second phase difference image constituted by a portion having a small phase difference, such that the first phase difference images are dispersed in the second phase difference image, and that a dispersion diameter of the first phase difference images is 150 nm or less.

2. The toner according to claim 1, wherein:

the crystalline polyester resin comprises a dihydric aliphatic alcohol component and a divalent aliphatic carboxylic acid component as constituent components; and the non-crystalline polyester resin comprises a dihydric aliphatic alcohol component and a polyvalent aromatic carboxylic acid component as constituent components.

3. The toner according to claim 1, wherein the first phase difference images have a dispersion diameter of from 10 nm to 100 nm.

4. The toner according to claim 1, wherein the copolymer resin is produced by reacting the crystalline polyester resin, the non-crystalline polyester resin, and an elongating agent comprising two or more of an isocyanate group, an epoxy group, and a carbodiimide group.

5. The toner according to claim 1, wherein the binder resin further comprises a second crystalline resin.

6. A developer, comprising:

the toner of claim 1.

7. An image forming apparatus, comprising:

an electrostatic latent image bearing member;

an electrostatic latent image forming unit configured to form an electrostatic latent image on the electrostatic latent image bearing member; and a developing unit comprising the toner of claim 1, and is configured to develop the electrostatic latent image formed on the electrostatic latent image bearing member to form a visible image.

8. An image forming method, comprising:

developing an electrostatic latent image formed on an electrostatic latent image bearing member with the toner of claim 1 to form a visible image;

transferring the visible image to a recording medium; and fixing the visible image transferred to the recording medium thereon.

* * * * *